US011084281B2

(12) United States Patent
Miura

(10) Patent No.: US 11,084,281 B2
(45) Date of Patent: Aug. 10, 2021

(54) POSITION DETECTION DEVICE, PRINTING APPARATUS AND POSITION DETECTION METHOD

(71) Applicant: CASIO COMPUTER CO., LTD., Tokyo (JP)

(72) Inventor: Shinsuke Miura, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 9 days.

(21) Appl. No.: 16/796,065

(22) Filed: Feb. 20, 2020

(65) Prior Publication Data

US 2020/0276805 A1 Sep. 3, 2020

(30) Foreign Application Priority Data

Feb. 28, 2019 (JP) ..... JP2019-035764

(51) Int. Cl.

*B41J 2/045* (2006.01)
*A45D 29/00* (2006.01)
*B41J 2/435* (2006.01)

(52) U.S. Cl.

CPC ..... *B41J 2/04573* (2013.01); *A45D 29/00* (2013.01); *B41J 2/04503* (2013.01); *B41J 2/04505* (2013.01); *B41J 2/435* (2013.01); *A45D 2029/005* (2013.01)

(58) Field of Classification Search

CPC ..... B41J 2/04503; B41J 2/04505; B41J 2/04573; A45D 2029/005

See application file for complete search history.

(56) References Cited

U.S. PATENT DOCUMENTS

2002/0084762 A1* 7/2002 Kurokawa ..... G05B 19/4015 318/560
2003/0234827 A1* 12/2003 Tsuruoka ..... B41J 19/202 347/14

FOREIGN PATENT DOCUMENTS

JP H05077514 A 3/1993

* cited by examiner

*Primary Examiner* — Matthew Luu
*Assistant Examiner* — Kendrick X Liu
(74) *Attorney, Agent, or Firm* — Holtz, Holtz & Volek PC

(57) ABSTRACT

Provided are a position detection device, a printing apparatus equipped with the position detection device and a position detection method which make it possible to set an original point on a deviation-free appropriate position with no need of highly accurate adjustment of built-in positions of a linear encoder and an original point sensor. In a case where a point that low-to-high switching of an output from a scale sensor is detected is set as a light transmission timing, a point that high-to-low switching of the output is detected is set as a light shielding timing and an output change point that an original point sensor detects is set as a detection timing, in a duration time D1 which lasts from the detection timing to a first light transmission timing which is the closest to the detection timing and a duration time D2 which lasts from the detection timing to a first light shielding timing which is the closest to the detection timing, when the duration time D1>the duration time D2, a position of a moving body which is obtained at a second light transmission timing is set as an original point and when the duration time D1<the duration time D2, the position of the moving body which is obtained at a second light shielding timing (the first light shielding timing) is set as the original point.

8 Claims, 10 Drawing Sheets

POSITION DETECTION DEVICE, PRINTING APPARATUS AND POSITION DETECTION METHOD

CROSS REFERENCE TO RELATED APPLICATIONS

This application is based upon and claims the benefit of priority under 35 USC 119 of Japanese Patent Application No. 2019-35764 filed on Feb. 28, 2019 the entire disclosure of which, including the description, claims, drawings, and abstract, is incorporated herein by reference in its entirety.

BACKGROUND

1. Field

The present invention relates to a position detection device, a printing apparatus and a position detection method.

2. Related Art

Nowadays, in the printing apparatus and so forth, it is known to install the position detection device which is configured by a linear encoder and so forth in order to accurately grasp a timing of an operation of a moving body which operates while moving.

For example, in Japanese Patent Application Laid Open No. Hei 5 (1993)-77514, an example that the linear encoder which has a linear scale which is installed along a moving direction of a print head of a printing apparatus (a carriage which loads the print head thereon) is installed on the printing apparatus as the position detection device which detects the position of the print head as the moving body is described.

In the printing apparatus, it is important to accurately grasp the position of the print head and to operate the print head at an appropriate timing in order to form a print which is beautifully finished with no deviation.

In order to perform printing at an appropriate position, the printing apparatus is configured to set an original point (also called a reference position, a home position and so forth) when performing an initialization operation, to detect an amount of movement (a moving distance) which is measured from the original point by the linear encoder and so forth and to control operations of the print head and so forth on the basis of this amount of movement.

As a technique of setting the original point (the reference position), provision of a section (a part A in Japanese Patent Application Laid Open No. Hei 5 (1993)-77514) on which a position detection part is not provided in a predetermined range on one end on the original point (the reference position) side of the linear scale (a scale plate in Japanese Patent Application Laid Open No. Hei 5 (1993)-77514) is described in Japanese Patent Application Laid Open No. Hei 5 (1993)-77514.

When the linear sensor reaches the part A, an output pulse ceases to change. Accordingly, in the invention which is described in Japanese Patent Application Laid Open No. Hei 5 (1993)-77514, in a case where it is sensed that the output pulse from the linear sensor does not change even when a predetermined time T1 has elapsed, a position counter is initialized and this position is set as the original point (the reference position).

SUMMARY

The present invention has been made under the above-mentioned circumstances.

According to one aspect of the present invention, there is provided a position detection device which detects a position of a moving body, including a position sensor which detects the moving body and outputs a detection signal;

a linear encoder which has a linear scale and a scale sensor and detects an amount of movement of the moving body in one direction; and a processor which controls the position sensor and the scale sensor, wherein a first section that an output from the scale sensor becomes low and a second section that the output from the scale sensor becomes high are alternately arranged on the linear scale, and in a case where an output change point that the scale sensor detects switching from the first section to the second section is set as a light transmission timing, an output change point that the scale sensor detects switching from the second section to the first section is set as a light shielding timing and an output change point that the position sensor detects is set as a detection timing, with the light transmission timing which is the closest to the detection timing being set as a first light transmission timing and the light shielding timing which is the closest to the detection timing being set as a first light shielding timing, the processor sets a position of the moving body which is obtained at a second light transmission timing which is the light transmission timing which comes after the detection timing as an original point position in the one direction or a reference position which serves as a reference of the original point position, (1) in a case where a duration time D1 between the detection timing and the first light transmission timing is longer than a duration time D2 between the detection timing and the first light shielding timing, and sets a position of the moving body which is obtained at a second light shielding timing which is the light shielding timing which comes after the detection timing as the original point position in the one direction or the reference position, (2) in a case where the duration time D1 is shorter than the duration time D2.

DETAILED DESCRIPTION

In the following, embodiments of a position detection device, a printing apparatus which is equipped with the position detection device and a position detection method according to the present invention will be described with reference to FIG. 1 to FIG. 14.

Incidentally, although, in the embodiments which will be described in the following, various definitions which are technically preferable for embodying the present invention are made, the definitions do not limit the scope of the present invention to the following embodiments and illustrated examples.

In addition, although in the embodiment which will be described in the following, description will be made by exemplifying a case where a printing apparatus is a nail printing apparatus which performs printing on nails of a person, the printing apparatus according to the present invention is not limited to the nail printing apparatus. In addition, a case where the nail printing apparatus performs the printing on a nail of a finger as a printing object is exemplified. However, in the present invention, in a case where the printing apparatus is the nail printing apparatus, the printing object is not limited to the nail of the finger and, for example, a nail of a toe may be used as the printing object. In addition, objects other than the nails such as surfaces and so forth of nail chips and various accessories may be used as the printing objects.

Figure 1:
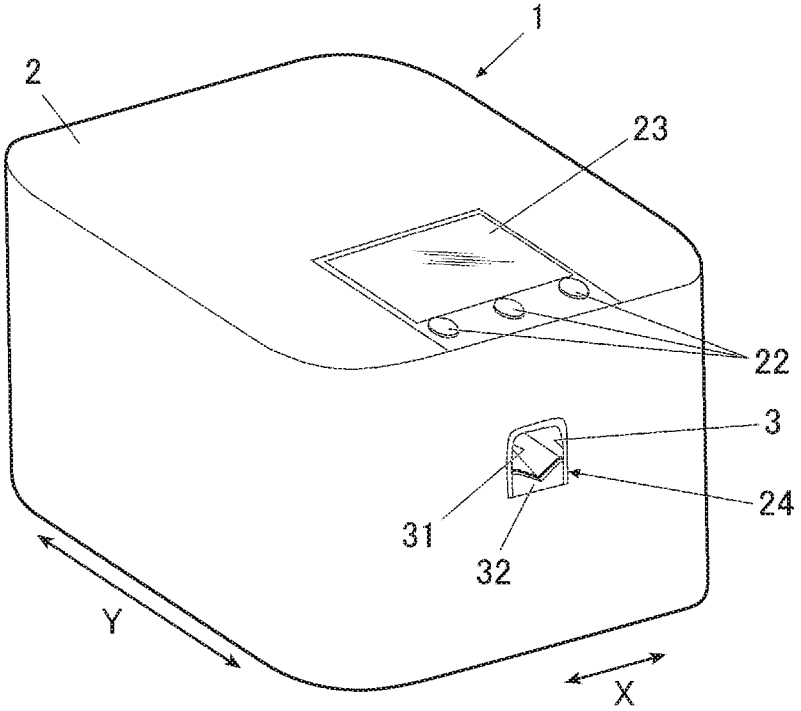
FIG. 1 is a perspective view illustrating one external appearance configuration example of a nail printing apparatus according to one embodiment of the present invention.

FIG. 1 is a perspective view illustrating one external appearance configuration example of a nail printing apparatus which is a printing apparatus according to one embodiment of the present invention.

As illustrated in FIG. 1, a nail printing apparatus 1 according to the present embodiment has a housing 2 which is made into an almost box-shaped form.

An operation unit 22 is installed on an upper face (a top board) of the housing 2.

The operation unit 22 is an input unit through which a user performs various inputting operations.

Operation buttons which are used for performing the various inputting operations such as, for example, a power source switch button which is used to turn ON a power source of the nail printing apparatus 1, a stop switch button which is used to stop each operation, a design selection button which is used to select a design image to be printed on a nail, a print start button which is used to instruct to start printing and so forth are arranged on the operation unit 22.

In addition, a display unit 23 is installed on the upper face (the top board) of the housing 2.

The display unit 23 is configured by a flat display and so forth such as, for example, a liquid crystal display (LCD), an organic electroluminescence display and others.

In the present embodiment, for example, a nail image (a finger image which includes the nail image) which is captured by taking a photograph of a finger which is not illustrated in FIG. 1, images of the nail contour line and so forth which are included in this nail image, a design selection screen which is used to select a design image to be printed on the nail, a thumbnail image which is used for design confirmation, an instruction screen which displays various instructions and so forth are appropriately displayed on the display unit 23.

Incidentally, a touch panel which is used to perform the various inputting operations may be integrally configured on a surface of the display unit 23. In this case, the touch panel functions as the operation unit 22.

In addition, an opening 24 into which a finger with the nail which is the printing object is inserted when taking the photograph of the nail by a photographing unit 50 of the nail printing apparatus 1 and when performing a printing operation on the nail by a print unit 40 so as to set the nail in a photographing position where photographing of the nail by the photographing unit 50 is possible and in a printing position where printing on the nail by the print unit 40 is possible is formed in an X-direction (an X direction in FIG. 1) almost central part of the nail printing apparatus 1 on the front-face side (the front side in FIG. 1) of the housing 2.

A finger fixing mechanism 3 which fixes the finger with the nail which is the printing object is installed in the opening 24 as will be described later.

Figure 2:
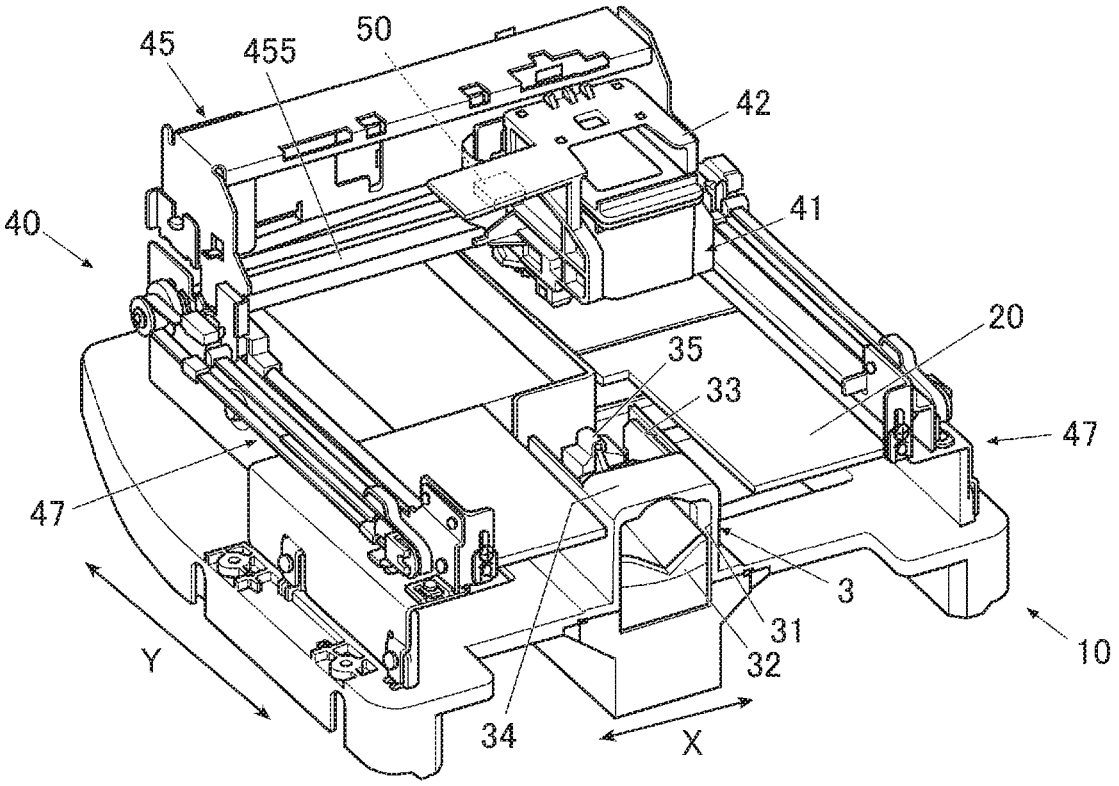
FIG. 2 is an essential part perspective view illustrating one internal configuration example in a state of removing a housing from a main body of the nail printing apparatus.

FIG. 2 is an essential part perspective view illustrating one internal configuration example of the nail printing apparatus 1 in a state of removing the housing 2 from a main body of the nail printing apparatus 1 illustrated in FIG. 1.

As illustrated in FIG. 2, a base 10 into which various internal structures are incorporated is installed in the housing 2.

The finger fixing mechanism 3 is installed in the opening 24 of the housing 2 at a position which is located on the front side (the Y-direction front side in FIG. 2) of the apparatus 1 on a base upper face 20 and a width-direction (the X direction in FIG. 2) almost central part of the apparatus 1.

The finger fixing mechanism 3 has a function of stably holding the finger with the nail which is the printing object.

The finger fixing mechanism 3 is a box-shaped member which has an opening 31 on the front side of the apparatus 1 and a finger fixing member 32 which fixes the finger is installed in the finger fixing mechanism 3.

The finger fixing member 32 is adapted to support the finger by pushing the finger upward from below and is made of, for example, flexible resin and so forth. In the present embodiment, the finger fixing member 32 is in the form that a width-direction (the X-direction in FIG. 2) almost central part is depressed, when the finger is placed on the finger fixing member 32, the finger fixing member 32 receives a cushion part of the finger and thereby it becomes possible to prevent the finger from becoming unsteady in the width direction (the X direction in FIG. 1 and FIG. 2) of the apparatus 1.

The top face inner side of the finger fixing mechanism 3 is configured as an opening window 33. The finger fixing mechanism 3 is configured in such a manner that the nail of the finger which is inserted into the finger fixing mechanism 3 is exposed to the outside through the window 33.

In addition, the top face front side of the finger fixing mechanism 3 is configured as a finger pressing part 34 which prevents floating of the finger so as to restrict an upward movement position of the finger.

Further, in the present embodiment, a nail placing part 35 on which a leading end of the nail which is the printing object is placed so as to restrict a height-direction position of the nail is installed on the finger insertion-direction inner side. The tip of the nail is placed on an upper face of the nail placing part 35 and thereby a horizontal-direction (that is, the X direction and a Y direction) position of the nail is restricted and also the height-direction position of the nail is restricted.

Incidentally, the finger fixing mechanism 3 may be configured to be detachable so as to be pulled out from the inside of the apparatus 1.

In addition, a print unit 40 which performs printing on a printing object face (that is, a surface of the printing object) is installed in the housing 2. In the present embodiment, the printing object face means the surface of the nail.

The print unit 40 includes a print head 41, a head carriage 42 which supports the print head 41, an X-direction movement motor 46 (see FIG. 4) which configures a movement mechanism which is adapted to move the print head 41 in the X direction (the X direction in FIG. 1, FIG. 2 and so forth, that is, a left-right direction of the nail printing apparatus 1), Y-direction movement stages 47 and a Y-direction movement motor 48 (see FIG. 4) which are adapted to move the print head 41 in the Y direction (the Y direction in FIG. 1, FIG. 2 and so forth, that is, a front-back direction of the nail printing apparatus 1), a position detection device 70 which detects the position of the print head 41 and so forth (for example, the head carriage 42 which supports the print head 41) which are configured as a moving body (hereinafter, referred to as "the moving body (the print head 41 and so forth)") and so forth.

In the present embodiment, the moving body (the print head 41 and so forth) is movably attached to a guide shaft 455 (see FIG. 3) which extends in the X direction (the X direction in FIG. 1, FIG. 2 and so forth, that is, the left-right direction of the nail printing apparatus 1).

In addition, the moving body (the print head 41 and so forth) is configured to be movable, along the Y-direction, on the Y-direction movement stages 47 which are installed on the apparatus width-direction (the X direction in FIG. 1, FIG. 2 and so forth, that is, the left-right direction of the nail printing apparatus 1) both sides of the base 10 so as to extend in the Y direction (the Y direction in FIG. 1, FIG. 2 and so forth, that is, the front-back direction of the nail printing apparatus 1) respectively in a state of being supported on the guide shaft 455.

In the present embodiment, the print head 41 is an ink jet head which performs printing by an ink jet system.

The print head 41 is the moving body which performs an ink ejecting operation while moving reciprocally and performs the printing on the nail which is the printing object on the basis of nail information and so forth which are detected by a nail information detection section 812 which will be described later.

The print head 41 is an ink cartridge integrated type head that, for example, not illustrated ink cartridges which correspond to yellow (Y), magenta (M) and cyan (C) inks respectively and not illustrated ink injection surfaces which are installed on surfaces of the respective ink cartridges which face the printing object (the surface of the nail) are formed in a mutually integrated state. Injection ports (ink injection ports, not illustrated) in a nozzle array which is configured by a plurality of nozzles which inject inks of the respective colors are formed in each ink injection surface in a line. The print head 41 performs the printing on the nail by making each ink into extremely fine droplets and spraying the ink from the ink injection surface (the ink injection ports in the ink injection surface) directly to the surface of the nail. Incidentally, the print head 41 is not limited to the type of injecting the inks of the above-mentioned three colors. The print head 41 may include ink cartridges which store inks of other colors and ink ejection ports for the inks of other colors.

In the present embodiment, a head movement mechanism 49 (see FIG. 4) which is capable of moving the print head 41 on an XY plane in the X direction and the Y direction by the X-direction movement motor 46, the Y-direction movement motor 48 and so forth is configured and an operation of the head movement mechanism 49 is controlled by a control device 80 (in particular, a print control section 814, see FIG. 4) which will be described later.

In addition, as will be described later, the operation of the moving body (the print head 41 and so forth) is instructed and controlled by the print control section 814 in accordance with a result of detection by the position detection device 70.

That is, in the present embodiment, the print head 41 is configured to start the printing operation and to appropriately eject the inks in accordance with an ink ejection start timing (an operation start timing in the present embodiment) and an in-printing ink ejection timing (an operation instruction timing in the present embodiment) which are set in accordance with the result of detection by the position detection device 70.

The position detection device 70 according to the present embodiment is adapted to detect the position of the moving body (the print head 41 and so forth) in the X-direction (the X direction in FIG. 1 and so forth, that is, the left-right direction of the nail printing apparatus 1).

Figure 3:
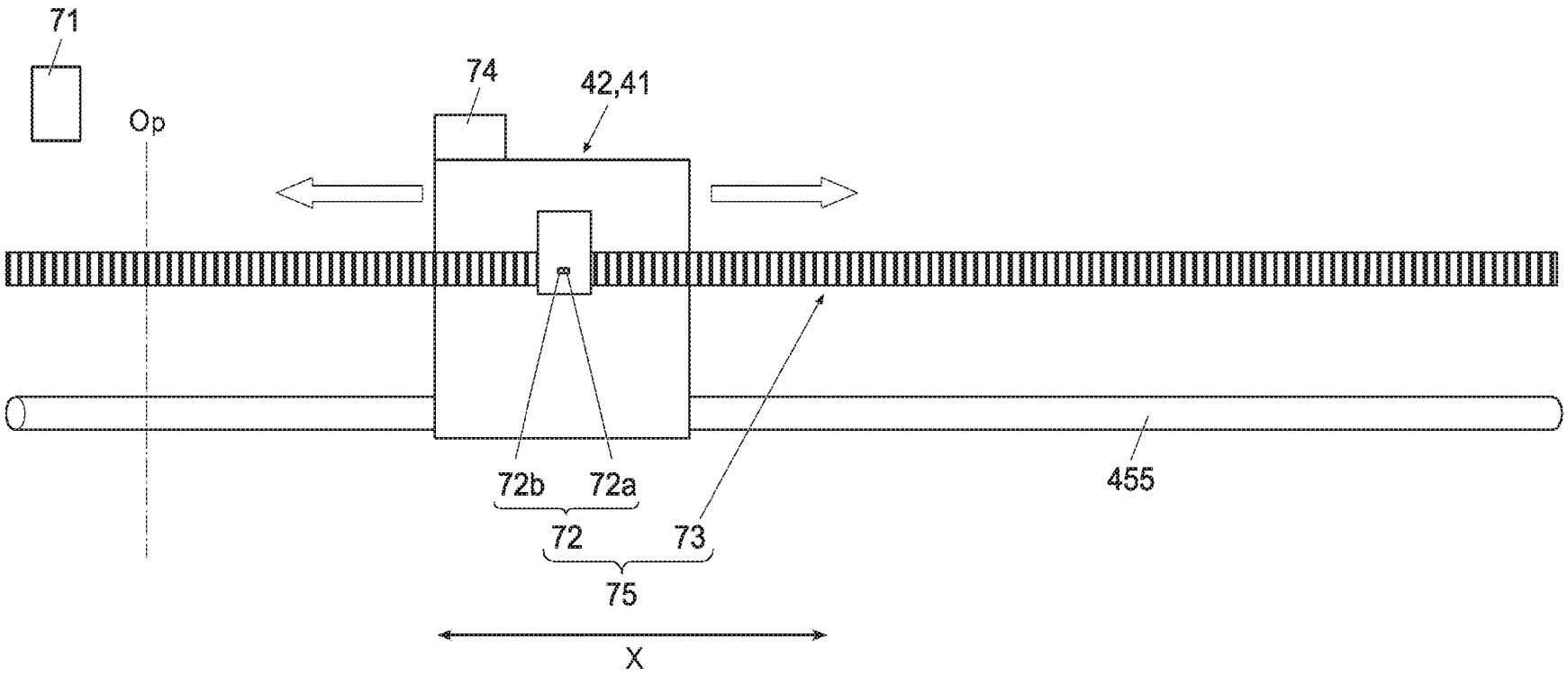
FIG. 3 is a schematic back-face view illustrating one essential part configuration example of a position detection device according to the present embodiment.

The position detection device 70 includes an original point sensor 71 (a position sensor, see FIG. 3) and a linear encoder 75 (see FIG. 3). A position detection control section 816 (see FIG. 4) controls operations of the original point sensor 71 and the linear encoder 75.

A configuration example of the original point sensor 71 and the linear encoder 75 of the position detection device 70 and periphery of the print head 41 is schematically illustrated in FIG. 3.

As illustrated in FIG. 3, the linear encoder 75 (a linear scale 73 of the linear encoder 75) is installed so as to extend in the X direction (the X direction in FIG. 1 and so forth, that is, the left-right direction of the nail printing apparatus 1, also called one direction), and the original point sensor 71 is installed in the vicinity of an end on either the left side or the right side (the side that the original point is set) of the linear scale 73.

When the moving body (the print head 41 and so forth) arrives at a predetermined reference position, the original point sensor 71 detects arrival of the moving body and outputs a detection signal. The original point sensor 71 is configured by a photo-interrupter or the like which has, for example, a light emission unit and a light reception unit (none of them is illustrated) which mutually face and decides presence/absence and a position of an object by detecting that the object blocks light from the light emission unit by the light reception unit.

In the present embodiment, a light shielding plate 74 is installed on, for example, the moving body (the print head 41 and so forth). In a case where the light shielding plate 74 passes between the light emission unit and the light reception unit of the original point sensor 71 with movement of the moving body (the print head 41 and so forth), the light shielding plate 74 blocks the light from the light emission unit and thereby an output from the original point sensor 71 is changed. The original point sensor 71 detects a point (an output change point) that the output is changed due to passage of the light shielding plate 74 as a detection timing. The position detection control section 816 which will be described later sets an original point (an original point position) Op on the basis of the detection timing.

Incidentally, a concrete way of setting the original point Op will be described later.

The linear encoder 75 includes the linear scale 73 and a scale sensor 72 and detects an amount of movement (a moving distance) of the moving body (the print head 41 and so forth).

In the present embodiment, the scale sensor 72 is a two-phase type photo-interrupter that, for example, two light reception units are arranged in such a manner that a rectangular wave output phase difference between the two light reception units becomes ¼ cycle and is configured by an A-phase output sensor 72*a* and a B-phase output sensor 72*b*.

Figure 5:
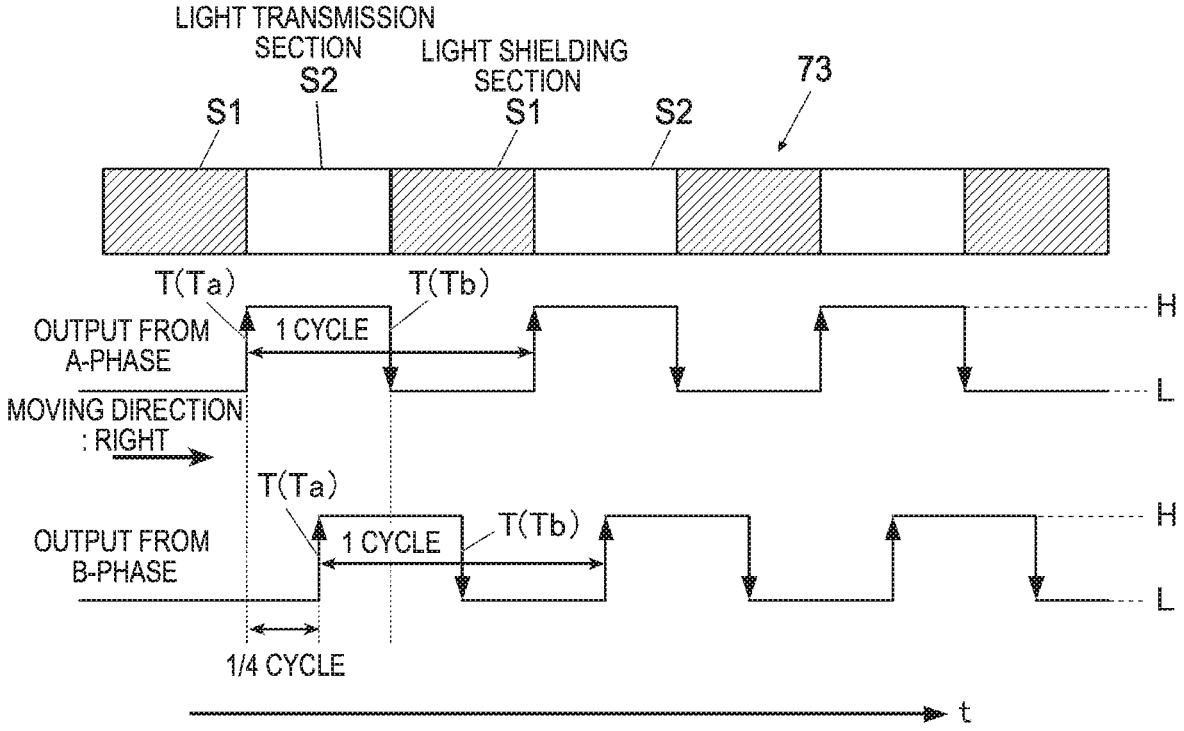
FIG. 5 is an explanatory diagram illustrating one example of output waveforms of a scale sensor of a linear encoder.

The linear scale 73 is configured that one set of a light shielding section and a light transmission section (a slit section) is defined as one cycle (see FIG. 5 and so forth). A length of one cycle is about several tens of micrometers to several hundreds of micrometers. The A-phase output sensor 72*a* and the B-phase output sensor 72*b* are arranged separately from each other by a distance which corresponds to ¼ cycle of the length of one cycle.

In the present embodiment, the scale sensor 72 is attached to the moving body (the print head 41 and so forth).

Incidentally, in the following, in a case where the A-phase output sensor 72*a* and the B-phase output sensor 72*b* are not particularly distinguished from each other, the A-phase output sensor 72*a* and the B-phase output sensor 72*b* will be simply called the "scale sensor 72".

In the present embodiment, a section that an output from the scale sensor 72 (the sensors 72*a* and 72*b*) becomes "Low" ("L" in FIG. 5 and so forth) on the linear scale 73 is set as a first section S1 and a section that the output from the scale sensor 72 (the sensors 72*a* and 72*b*) becomes "High" ("H" in FIG. 5 and so forth) is set as a second section S2.

Specifically, the first section S1 that the output from the scale sensor 72 (the sensors 72*a* and 72*b*) becomes low (L) is the light shielding section of the linear scale 73 and the second section S2 that the output from the scale sensor 72 (the sensors 72*a* and 72*b*) becomes high (H) is the light transmission section of the linear scale 73.

The linear scale 73 is configured by alternately arranging the first section S1 which is the light shielding section and the second section S2 which is the light transmission section and the scale sensor 72 (the sensors 72*a* and 72*b*) alternately outputs low (L)-level and high (H)-level waveform signals (pulses) repetitively with movement of the moving body (the print head 41 and so forth).

Accordingly, it becomes possible to find the number of cycles that the moving body (the print head 41 and so forth) moves by counting the number of the low (L)-level or high (H)-level waveform signals (pulses) which are output from the scale sensor 72 and thereby it becomes possible to detect the amount of movement (the moving distance) of the moving body (the print head 41 and so forth) by multiplying the number of signals (pulses) by the length of one cycle.

Incidentally, in the present embodiment, the length of one cycle of the linear scale 73 is about several tens of micrometers to several hundreds of micrometers as described above. The length of one cycle of the linear scale 73 is appropriately set in accordance with a definition of the nail printing apparatus 1 which is the printing apparatus. In a case where it is requested to perform high-definition printing, the linear scale 73 which is short in cycle (that is, an arrangement pattern of the light shielding section S1 and the light transmission section S2 is fine) is applied.

In addition, in the present embodiment, the photographing unit 50 is attached to part of the head carriage 42 which supports the print head 41. Specifically, an upper face of the head carriage 42 partially projects sideways and the photographing unit 50 is installed onto a lower-side face of the projecting part.

The photographing unit 50 is a photographing unit which takes a photograph of a nail and captures a nail image which is an image of the finger with the nail. The photographing unit 50 includes a photographing section 51 and an illumination section 52.

In the present embodiment, the photographing unit 50 illuminates the nail with the illumination section 52 and takes the photograph of the nail by the photographing section 51 in a state where the finger is fixed onto the finger fixing mechanism 3 and the nail tip is placed on the nail placing part 35.

The photographing unit 50 is connected to a photograph control section 811 (see FIG. 4) of the control device 80 which will be described later so as to be controlled by the photograph control section 811.

Incidentally, image data of the image which is captured by taking the photograph of the nail by the photographing unit 50 is stored into a nail information storage area 822 and so forth which will be described later.

In the present embodiment, the photographing unit 50 is configured to be made movable in the X direction and the Y direction by the head movement mechanism 49 which is configured by the X-direction movement motor 46, the Y-direction movement motor 48 and so forth.

Incidentally, the photographing unit 50 may be of any type, as long as the photographing unit 50 is capable of taking the photograph of the nail which is placed in the finger fixing mechanism 3 and there is no particular limitation on concrete arrangement and so forth of the photographing unit 50.

A movement mechanism which moves the photographing unit 50 in the X direction and the Y direction may be installed besides the head movement mechanism 49 so as to configure that the photographing unit 50 is moved by the movement mechanism. In addition, the photographing unit 50 may be installed on the inner side of the upper face (the top plate) of the housing 2 in a state of being fixed to the position above the window 33 of the finger fixing mechanism 3 and so forth.

The control device 80 is installed on a main substrate (not illustrated in the drawing) or the like which is placed on, for example, the lower-face side (that is, on an inner-side face of the apparatus 1) or the like of the top face of the housing 2. Incidentally, the substrates may be also installed on the X-direction movement stage 45, the head carriage 42 and so forth in a distributed form, in addition to the main substrate which is placed on the lower-face side or the like of the top face of the housing 2. In this case, the plurality of substrates is mutually connected electrically and thereby the respective components are configured to be all-inclusively controlled and to operate in cooperation with one another. For example, a sub substrate which configures the position detection control section 816 which will be described later may be placed in the vicinity and so forth of the position detection device 70 besides the main substrate.

Figure 4:
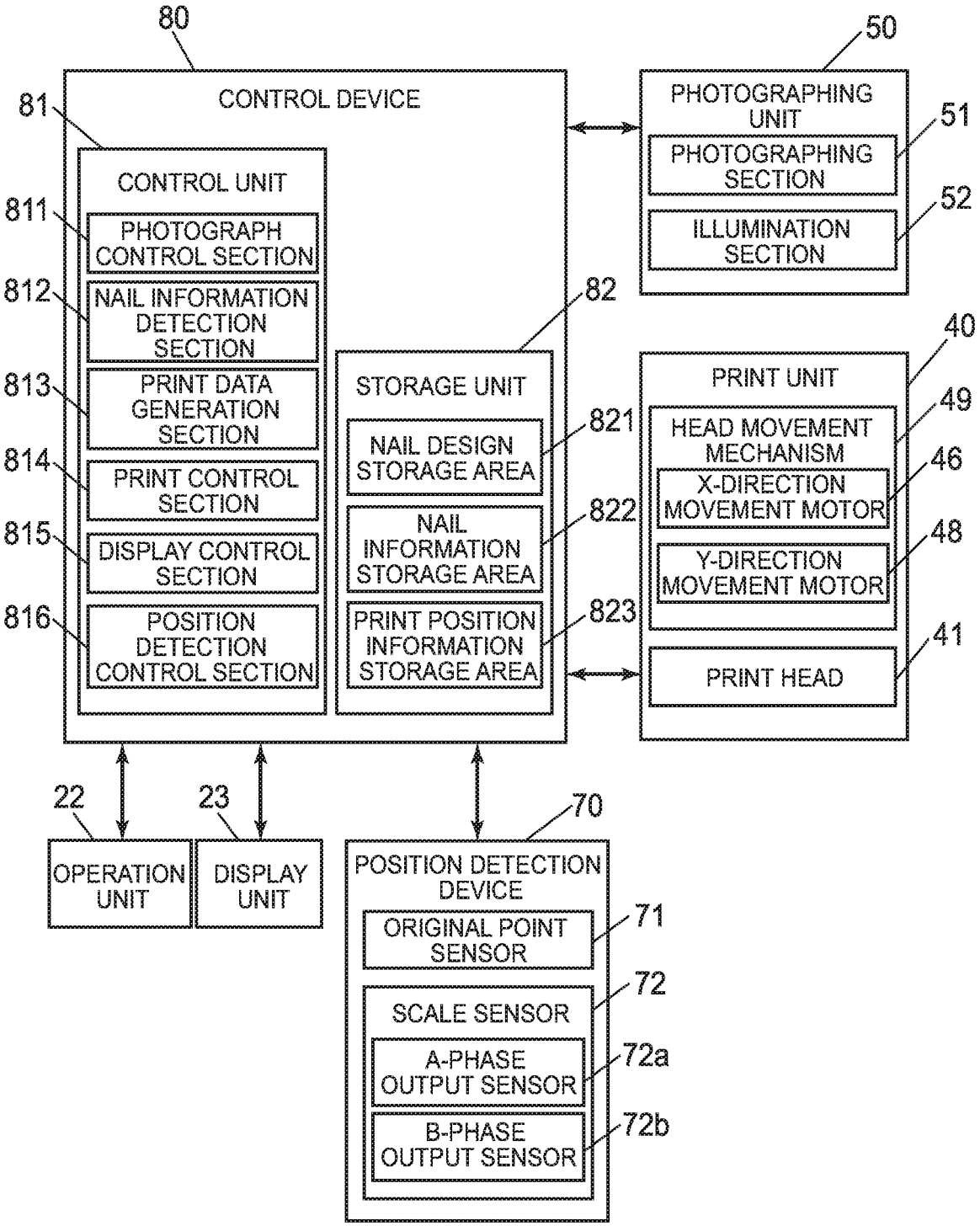
FIG. 4 is an essential part block diagram illustrating one control configuration example of the nail printing apparatus according to the present embodiment.

FIG. 4 is an essential part block diagram illustrating one control configuration example in the present embodiment.

As illustrated in FIG. 4, the control device 80 is a computer which includes a control unit 81 which is configured by a CPU (Central Processing Unit) and so forth which are not illustrated in FIG. 4 and a storage unit 82 which is configured by a ROM (Read Only Memory), a RAM (Random Access Memory) and so forth (none of them is illustrated in FIG. 4).

Various kinds of programs, various kinds of data and so forth which are used to operate the nail printing apparatus 1 are stored in the storage unit 82.

Specifically, the various kinds of programs such as, for example, a nail information detection program which is used to detect various kinds of nail information on the shape of the nail, the contour of the nail, a width of the nail, a curvature of the nail and so forth from the nail image, a printing data generation program which is used to generate data for printing, a print program which is used to perform print processing, a position detection program which is used to detect the position of the moving body (the print head 41 and so forth) and so forth are stored in the storage unit 82. These programs are executed by the control device 80 and thereby the respective components of the nail printing apparatus 1 are all-inclusively controlled.

In addition, in the present embodiment, a nail design storage area 821 which is used to store image data on nail designs to be printed on the nail, a nail information storage area 822 which is used to store nail images of the nails of the user which are acquired by the photographing unit 50 and various kinds of nail information (the contour of the nail, the width of the nail, a tilt angle of the nail (the curvature of the nail) and so forth) which are obtained by analyzing the nail images, a print position information storage area 823 which is used to store position information on the position of the moving body (the print head 41 and so forth) and so forth which are acquired by the position detection device 70 and so forth are provided in the storage unit 82.

In a case of seeing the control unit 81 from a functional viewpoint, the control unit 81 includes the photograph control section 811, the nail information detection section 812, a print data generation section 813, the print control section 814, a display control section 815, the position detection control section 816 and so forth. Functions of the control unit 81 which works as the photograph control section 811, the nail information detection section 812, the print data generation section 813, the print control section 814, the display control section 815, the position detection control section 816 and so forth are realized by cooperation of the CPU of the control unit 81 with the programs which are stored in the storage unit 82.

The photograph control section 811 is configured to control the operations of the photographing section 51 and the illumination section 52 of the photographing unit 50 so as to make the photographing section 51 capture the images of the nail (the nail images) of the finger which is fixed to the finger fixing mechanism 3.

The image data on the nail images which are captured by the photographing unit 50 is stored into the nail information storage area 822 of the storage unit 82.

The nail information detection section 812 is adapted to detect the nail information on the basis of the nail images which are captured by the photographing section 51.

Here, the nail information is, for example, the contour of the nail (the shape of the nail, horizontal-position XY coordinates of the nail and so forth), a height of the nail (a vertical position of the nail, in the following also called the "nail vertical position" or simply called the "nail position"), the curvature (a degree of curve) of the nail and so forth. Incidentally, the nail information is not limited to the information which is exemplified here.

The nail information detecting section 812 analyzes the nail images and thereby these pieces of the nail information are detected. There is no particular limitation on a concrete method of analyzing the nail images.

The nail information which is a result of detection which is performed by the nail information detection section 812 is stored into the nail information storage area 822 of the storage unit 82.

The print data generation section 813 generates data for printing to be performed on the nail by the print head 41 on the basis of the nail information which is detected by the nail information detection section 812.

Specifically, the print data generation section 813 performs matching processing of matching the image data of the nail design with the shape of the nail, by performing processing such as enlargement, reduction, segmentation and so forth on the image data on the nail design on the basis of the shape and so forth of the nail which are detected by the nail information detection section 812.

Further, the print data generation section 813 generates the data for printing to be performed on the surface of the nail which is a printing object surface by appropriately performing correction.

In addition, in a case where the curvature and so forth of the nail are acquired by the nail information detection section 812, the print data generation section 813 may appropriately perform curved surface correction, for example, by performing density adjustment and so forth so as not to reduce print density of the both ends of the nail in accordance with the curvature of the nail.

The print control section 814 is a control section which outputs a control signal to the print unit 40 on the basis of the data for printing which is generated by the print data generation section 813 and controls the X-direction movement motor 46, the Y-direction movement motor 48, the print head 41 and so forth of the print unit 40 so as to perform the printing which follows the data for printing on the nail.

In addition, in the present embodiment, the print control section 814 performs accurate print control by referring to also the position information and so forth on the print head 41 which are detected by the position detection device 70.

The display control section 815 is adapted to control the display unit 23 so as to make the display unit 23 display various display screens.

In the present embodiment, the display control section 815 is configured to make the display unit 23 display, for example, the nail images which are captured by taking photographs of the fingers, a design selection screen which is used to select an image to be printed on the nail (that is, the "nail design"), the thumbnail image which is used for design confirmation, an instruction screen which is used to display various instructions and so forth.

The position detection control section 816 is a control section which controls the original point sensor 71 and the scale sensor 72 (the A-phase output sensor 72*a* and the B-phase output sensor 72*b*) which configure the position detection device 70.

In the present embodiment, the position detection control section 816 sets the original point of the moving body (the print head 41 and so forth) by performing calibration by such a method as follows. Since the calibration is performed at the time of factory inspection or when an instruction is given from the user, the original point which is set at that time point is unchangeable and is different from an original point (in the following, referred to as a "temporary original point") which is changed every time an initialization operation is executed.

Figure 7A:
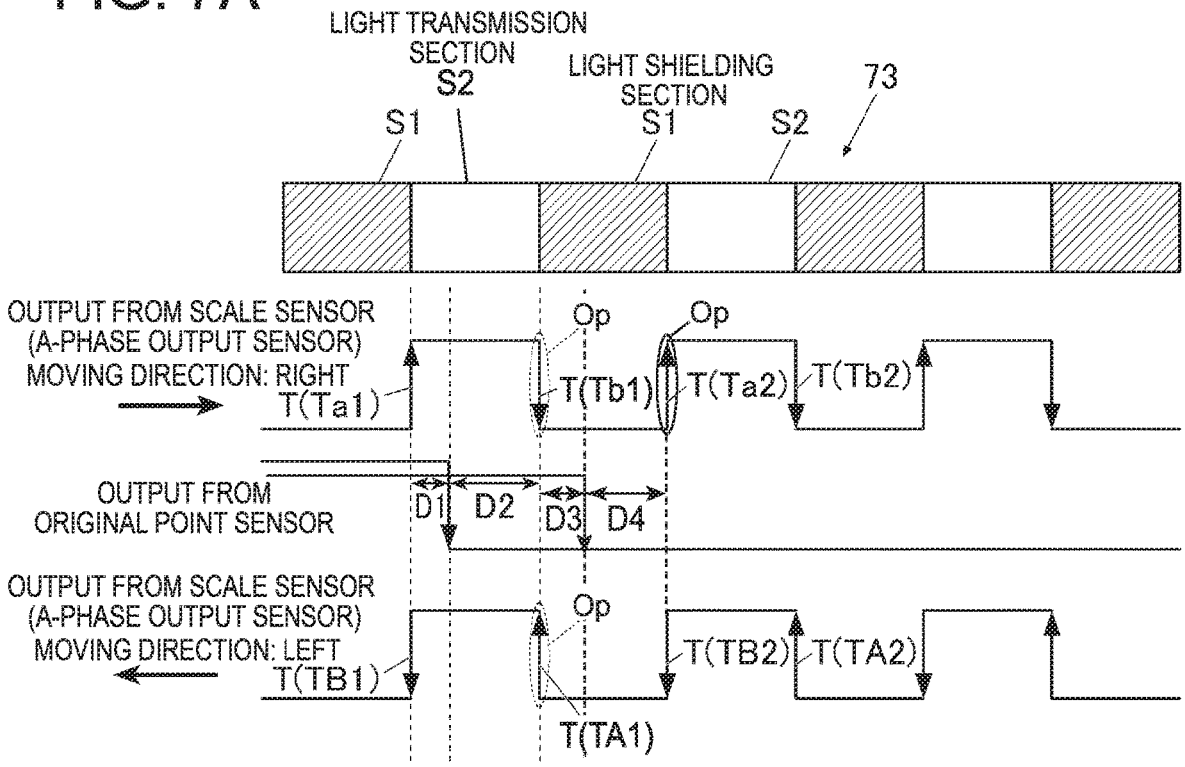
FIG. 7A is an explanatory diagram illustrating one example of a way of setting the original point in the position detection device according to the present embodiment.
Figure 7B:
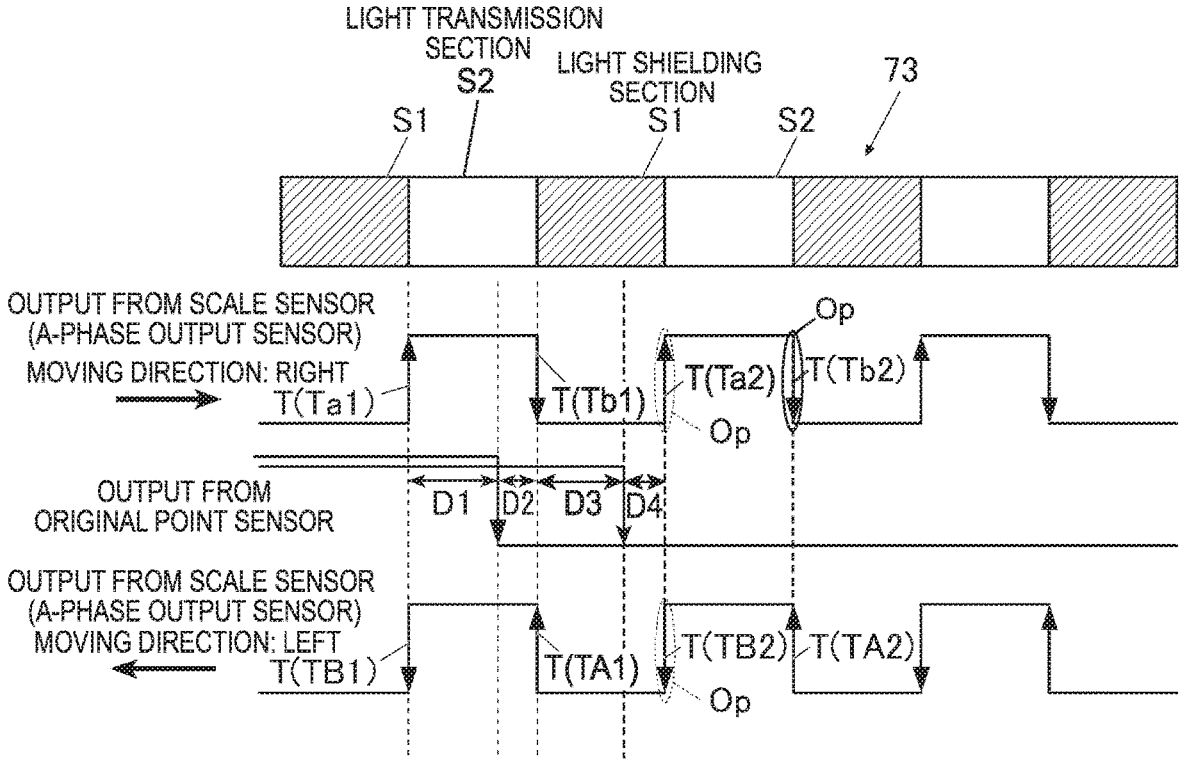
FIG. 7B is an explanatory diagram illustrating another example of the way of setting the original point in the position detection device according to the present embodiment.

In the preset embodiment, in a case where the moving body (the print head 41 and so forth) moves in a rightward direction, as illustrated in FIG. 7A, FIG. 7B and so forth, an output change point T that the A-phase output sensor 72*a* detects switching from a first section S1 to a second section S2 (that is, a sensor output rising timing that the A-phase output sensor 72*a* detects an edge of a boundary at which switching from the light shielding section to the light transmission section of the linear scale 73 is conducted) is set as a light transmission timing Ta, the output change point T that the A-phase output sensor 72*a* detects switching from the second section S2 to the first section S1 (that is, a sensor output falling timing that the A-phase output sensor 72*a* detects an edge of a boundary at which switching from the light transmission section to the light shielding section of the linear scale 73 is conducted) is set as a light shielding timing Tb, and an output change point that the original point sensor 71 detects (that is, in the present embodiment, the output change point that the output from the original point sensor 71 switches from a high (H)-level to a low (L)-level because the light shielding plate 74 passes by the original point sensor 71) is set as a detection timing.

In this case, the position detection control section 816 compares a duration time D1 between the detection timing and a first light transmission timing Ta1 which is the closest to the detection timing with a duration time D2 between the detection timing and a first light shielding timing Tb1 which is the closest to the detection timing. In a case where a relation of the duration time D1>the duration time D2 is satisfied, the position detection control section 816 sets the point (the output change point T) that switching from the first section S1 to the second section S2 is conducted after the detection timing as a second light transmission timing Ta2 and sets the position of the moving body (the print head 41 and so forth) which is obtained at the output change point T which is the second light transmission timing Ta2 as an X-direction original point Op of the moving body (the print head 41 and so forth). In addition, in a case where a relation of the duration time D1<the duration time D2 is satisfied, the position detection control section 816 sets the point (the output change point T) that switching from the second section S2 to the first section S1 is conducted after the detection timing as a second light shielding timing (a first light shielding timing) Tb1 and sets the position of the moving body (the print head 41 and so forth) which is obtained at the output change point T which is the second light shielding timing (the first light shielding timing) Tb1 as the X-direction original point Op of the moving body (the print head 41 and so forth).

In addition, in a case where the detection timing is set while the A-phase output sensor 72*a* is outputting the low (L)-level waveform signal (pulse), the position detection control section 816 compares a duration time D3 between the detection timing and the first light shielding timing Tb1 which is the closest to the detection timing with a duration time D4 between the detection timing and the second light transmission timing Ta2 which is the closest to the detection timing, in a case where a relation of the duration time D3>the duration time D4 is satisfied, sets the point (the output change point T) that switching from the second section S2 to the first section S1 is conducted after the detection timing as the second light shielding timing Tb2, and sets the position of the moving body (the print head 41 and so forth) which is obtained at the output change point T which is the second light shielding timing Tb2 as the X-direction original point Op of the moving body (the print head 41 and so forth). In addition, in a case where a relation of the duration time D3<the duration time D4 is satisfied, the position detection control section 816 sets the point (the output change point T) that switching from the first section S1 to the second section S2 is conducted after the detection timing as the second light transmission timing (the first light transmission timing) Ta2 and sets the position of the moving body (the print head 41 and so forth) which is obtained at the output change point T which is the second light transmission timing (the first light transmission timing) Ta2 as the X-direction original point Op of the moving body (the print head 41 and so forth).

That is, in the present embodiment, in a case where the detection timing is set while the A-phase output sensor 72*a* is outputting the high (H)-level waveform signal (pulse), the first light shielding timing and the second light shielding timing are set to the same output change point T. In a case where the detection timing is set while the A-phase output sensor 72*a* is outputting the low (L)-level waveform signal (pulse), the first light shielding timing and the second light shielding timing are set to the different output change points T and the first light transmission timing and the second light transmission timing are set to the same output change point T.

When the position of the moving body (the print head 41 and so forth) which is obtained at the output change point T (the light transmission timing Ta or the light shielding timing Tb) of the A-phase output sensor 72*a* which is detected first after the detection timing (the output change point) of the original point sensor 71 is set as the X-direction original point Op of the moving body (the print head 41 and so forth), in a case where the detection timing (the output change point) of the original point sensor 71 is close to the light transmission timing Ta or the light shielding timing Tb which is the output change point T of the A-phase output sensor 72*a*, there is a fear that a slight deviation between the detection timings (the output change points) of the original point sensor 71 may lead to a great deviation between the original points Op of the moving body (the print head 41 and so forth)

Figure 6:
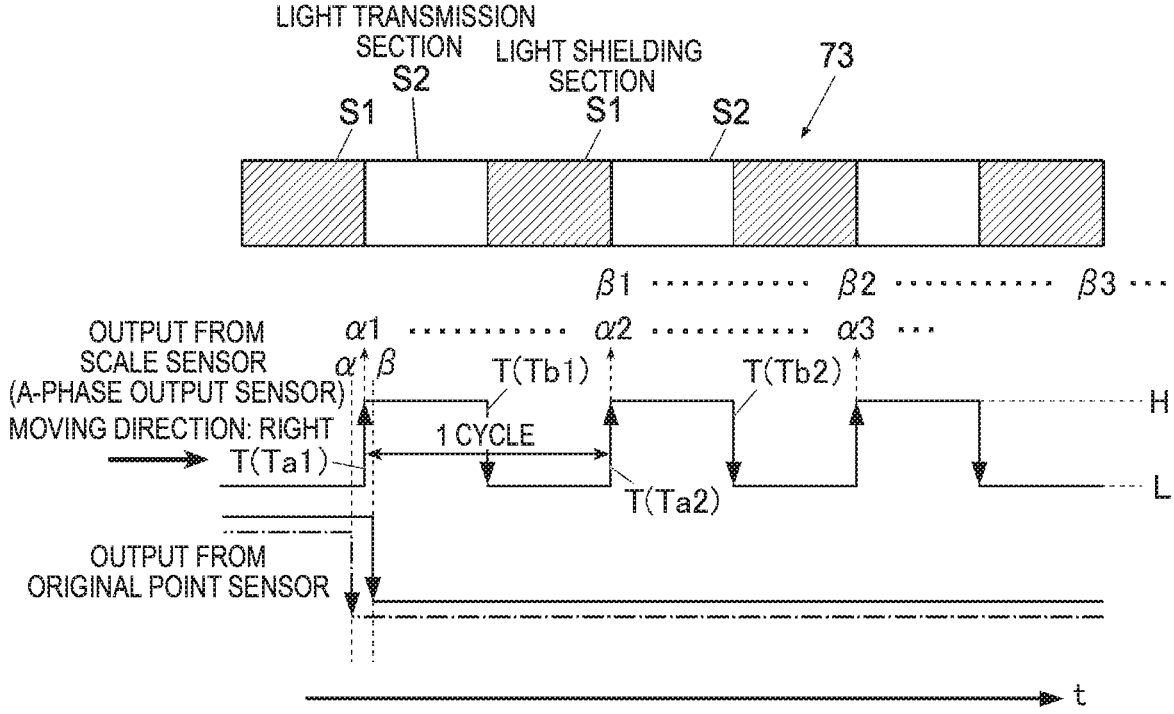
FIG. 6 is an explanatory diagram illustrating one example of detection timing setting by the scale sensor and of original point setting by an original point sensor of the linear encoder.

For example, at the time of calibration, in a case where the position of the moving body (the print head 41 and so forth) which is obtained at the first light transmission timing Ta1 (the output change point T) which is detected by the A-phase output sensor 72*a* first after the detection timing (the output change point) of the original sensor 71 and that switching from the first section S1 to the second section S2 is conducted is set as the original point Op, when the detection timing (the output change point) of the original point sensor 71 is a as illustrated in FIG. 6, the closest light transmission timing Ta1 (α1) which comes after α is set as the temporary original point by execution of initialization processing and the first cycle α1 is started from this temporary original point and an operation timing is counted in order of α2, α3, . . . and therefore no deviation occurs.

On the other hand, in a case where the detection timing (the output change point) of the original point sensor 71 is β, the closest light transmission timing Ta2 (β1) which comes after β is set as the temporary original point by execution of the initialization processing and the first cycle β1 is started from this temporary original point and the operation timing is counted in order of β2, β3, . . . and therefore a deviation of the amount which almost corresponds to one cycle of the linear scale 73 occurs relative to the original point Op which is set by the calibration.

There are cases where the deviation occurs in the detection timing (the output change point) of the original point sensor 71 due to slight changes in temperature and light amount of the original point sensor 71, waveform dullness, a change in passing speed of the moving body (the print head 41 and so forth) and so forth.

Figure 8A:
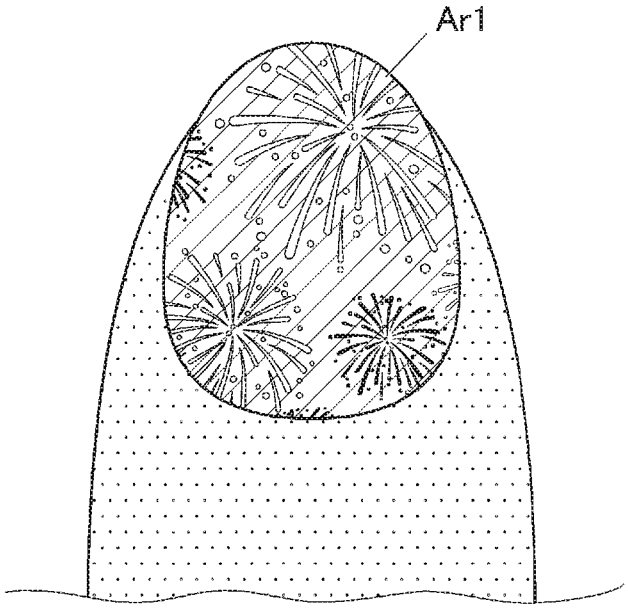
FIG. 8A is a plan view illustrating one example of a printed result which is obtained in a case where the printing is performed in a state where no deviation occurs on the original point.

The temporary original points (α1, β1 in FIG. 6) are initialized when executing the initialization processing on the nail printing apparatus 1 which is the printing apparatus. Accordingly, the deviation occurs between the original point Op and the temporary original point due to occurrence of the slight deviation between the detection timings (the output change points) of the original point sensor 71 and therefore a printing start position is not found. Thus, although the printing is to be performed on the entire surface of the nail area which is a printing object area Ar1 as illustrated in FIG. 8A, there are cases where an unpainted area Ar2 is partially left in the printing object area Ar1 as illustrated in, for example, FIG. 8B.

In particular, in a case of performing nail printing on the nail, a white base or the like is applied onto the nail before printing for the purpose of improving color development of the ink to be printed as the case may be. In this case, when the unpainted area Ar2 is present, the unpainted part is observed more prominently.

In this respect, it is also logically possible to finely adjust an installation position mechanically and physically so as to avoid mutual overlapping and proximity between the detection timing (the output change point) of the original point sensor 71 and the output change point T (the light transmission timing Ta or the light shielding timing Tb) of the A-phase output sensor 72*a* by taking the occurrence of the deviation in detection timing (in output change point) of the original point sensor 71 like this into consideration. However, as described above, the scale width (the cycle) of the linear scale 73 of the linear encoder 75 is as fine as about several tens of micrometers to several hundreds of micrometers. Therefore, it is practically difficult to assemble the original point sensor 71 by appropriately adjusting the position of the original point sensor 71.

In this respect, in the present embodiment, the duration time D1 and the duration time D2 are compared with each other, in a case where the relation of the duration time D1>the duration time D2 is satisfied, the position of the moving body (the print head 41 and so forth) which is obtained at the second light transmission timing Ta2 is set as the original point Op by the calibration and in a case where the relation of the duration time D1<the duration time D2 is satisfied, the position of the moving body (the print head 41 and so forth) which is obtained at the second light shielding timing (the first light shielding timing) Tb1 is set as the original point Op by the calibration as described above. In addition, in a case where the duration time D3 is compared with the duration time D4 and the relation of the duration time D3>the duration time D4 is satisfied, the position of the moving body (the print head 41 and so forth) which is obtained at the second light transmission timing Ta2 is set as the original point Op by the calibration. In a case where the relation of the duration time D3<the duration time D4 is satisfied, the position of the moving body (the print head 41 and so forth) which is obtained at the second light transmission timing (the first light transmission timing) Ta2 is set as the original point Op by the calibration. Accordingly, the position of the moving body (the print head 41 and so forth) which is obtained at the same output change point T (the second light transmission timing Ta2 or the second light shielding timing (the first light shielding timing) Tb1) is set as the original point Op as long as the detection timings (the output change points) of the original point sensor 71 do not deviate from each other exceeding ½ (¼ cycle) of a duration time which lasts from the first light transmission timing Ta1 to the first light shielding timing Tb1 (that is, the duration time D1+the duration time D2). Likewise, the position of the moving body (the print head 41 and so forth) which is obtained at the same output change point T (the second light shielding timing Tb2 or the second light transmission timing (the first light transmission timing) Ta2) is set as the original point Op as long as the detection timings (the output change points) of the original point sensor 71 do not deviate from each other exceeding ½ (¼ cycle) of a duration time which lasts from the first light shielding timing Tb1 to the second light transmission timing Ta2 (that is, the duration time D3+the duration time D4). Thereby, even in a case where a slight deviation of an extent which would normally occur between the detection timings (the output change points) of the original point sensor 71 occurs, no deviation occurs between the original point Op and the temporary original point.

That is, in a case where the detection timing is set while the moving body (the print head 41 and so forth) is moving in the rightward direction and the A-phase output sensor 72*a* is outputting the high (H)-level waveform signal (pulse), in a case where the duration time D2 between the detection timing of the original point sensor 71 and the first light shielding timing Tb1 which is the closest to the detection timing is longer than the duration time D1 between the detection timing of the original point sensor 71 and the first light transmission timing Ta1 which is the closest to the detection timing (the duration time D1<the duration time D2), the position of the moving body (the print head 41 and so forth) which is obtained at the second light shielding timing (the first light shielding timing) Tb1 in the output change points T of the A-phase output sensor 72*a* is set as the original point Op as illustrated in FIG. 7A.

In addition, in a case where the duration time D1 between the detection timing of the original point sensor 71 and the first light transmission timing Ta1 which is the closest to the detection timing is longer than the duration time D2 between the detection timing of the original point sensor 71 and the first light shielding timing Tb1 which is the closest to the detection timing (the duration time D1>the duration time D2), the position of the moving body (the print head 41 and so forth) which is obtained at the second light transmission timing Ta2 in the output change points T of the A-phase output sensor 72*a* is set as the original point Op as illustrated in FIG. 7B.

On the other hand, in a case where the detection timing is set while the moving body (the print head 41 and so forth) is moving in the rightward direction and the A-phase output sensor 72*a* is outputting the low (L)-level waveform signal (pulse), in a case where the duration time D4 between the detection timing of the original point sensor 71 and the second light transmission timing Ta2 which is the closest to the detection timing is longer than the duration time D3 between the detection timing of the original point sensor 71 and the first light shielding timing Tb1 which is the closest to the detection timing (the duration time D3<the duration time D4), the position of the moving body (the print head 41 and so forth) which is obtained at the second light transmission timing (the first light transmission timing) Ta2 in the output change points T of the A-phase output sensor 72*a* is set as the original point Op as illustrated in FIG. 7A.

In addition, in a case where the duration time D3 between the detection timing of the original point sensor 71 and the first light shielding timing Tb1 which is the closest to the detection timing is longer than the duration time D4 between the detection timing of the original point sensor 71 and the second light transmission timing Ta2 which is the closest to the detection timing (the duration time D3>the duration time D4), the position of the moving body (the print head 41 and so forth) which is obtained at the second light shielding timing Tb2 in the output change points T of the A-phase output sensor 72*a* is set as the original point Op as illustrated in FIG. 7B.

Incidentally, in the present embodiment, in a case where a relation of the duration time D1=the duration time D2 (the duration time D3=the duration time D4) is satisfied, the position detection control section 816 sets the position of the moving body (the print head 41 and so forth) which is obtained at either the output change point T which is the second light transmission timing Ta2 or the output change point T which is the second light shielding timing (the first light shielding timing) Tb1 as the original point Op of the moving body (the print head 41 and so forth).

That is, in the above-mentioned case, even when either the output change point T which is the second light transmission timing Ta2 or the output change point T which is the second light shielding timing (the first light shielding timing) Tb1 is adopted, no change occurs in influence which would be imposed in a case where the deviation occurs between the detection timings (the output change points) of the original point sensor 71 and therefore the position detection control section 816 selectively adopts either the second light transmission timing Ta2 or the second light shielding timing (the first light shielding timing) Tb1.

In addition, in the present embodiment, the moving body (the print head 41 and so forth) is of the type of performing an operation while reciprocally moving in the predetermined range on the basis of instructions and control. That is, the moving body (the print head 41 and so forth)(the print head 41 in the strict sense) performs an ink ejecting operation while reciprocally moving in the left-right direction (the X direction in FIG. 1 and so forth) of the nail printing apparatus 1 in a movable range along the guide shaft 455 (see FIG. 3) which is installed on the nail printing apparatus 1.

In the case where the moving body (the print head 41 and so forth in the present embodiment) is of the type of operating while reciprocally moving in this way, the position detection control section 816 adopts the output change point T which corresponds to the output change point T which is set as the original point Op of the moving body (the print head 41 and so forth) on the forward path also as the original point Op of the moving body (the print head 41 and so forth) on the backward path.

For example, in a case where the position of the moving body (the print head 41 and so forth) which is obtained at the second light shielding timing (the first light shielding timing) Tb1 is set as the original point Op on the forward path, the position detection control section 816 adopts the position of the moving body (the print head 41 and so forth) which is obtained at a first light transmission timing TA1 which is the backward-path output change point T (that is, a timing that the edge which is the same as the edge which becomes the boundary between the first section S1 and the second section S2 of the linear scale 73 that the A-phase output sensor 72*a* detects on the forward path is detected) which corresponds to the output change point T of the position which is set as the original point Op on the forward path as the original point Op on the backward path as in the case illustrated in FIG. 7A.

In addition, in a case where the position of the moving body (the print head 41 and so forth) which is obtained at the second light transmission timing Ta2 is set as the original point Op on the forward path, the position detection control section 816 adopts the position of the moving body (the print head 41 and so forth) which is obtained at a second light shielding timing TB2 which is the backward-path output change point T (that is, the timing that the edge which is the same as the edge which becomes the boundary between the first section S1 and the second section S2 of the linear scale 73 that the A-phase output sensor 72*a* detects on the forward path is detected) which corresponds to the output change point T of the position which is set as the original point Op on the forward path as the original point Op on the backward path as in the case illustrated in FIG. 7B.

Incidentally, in the present embodiment, a rightward moving direction is called the forward path, a leftward moving direction is called the backward path, and on the backward path (the leftward moving direction), the output change point T that switching from the first section S1 to the second section S2 is conducted is set as a light transmission timing TA and the output change point T that switching from the second section S2 to the first section S1 is conducted is set as a light shielding timing TB. In the following, in a case where both the forward path and the backward path are included, the light transmission timing and the light shielding timing will be described as a light transmission timing Ta(A) and a light shielding timing Tb(B), respectively.

In addition, the position detection control section 816 detects a moving direction, that is, in which direction the moving body (the print head 41 and so forth) moves between the leftward and rightward directions by seeing the output from the scale sensor 72.

That is, as described before, in the present embodiment, two scale sensors 72 which alternately repeat outputting of the low (L)-level and high (H)-level waveform signals (pulses) are installed on the linear encoder 75 in such a manner that the rectangular wave output phase difference becomes ¼ cycle.

Accordingly, for example, in a case where the moving body (the print head 41 and so forth) is moving in the rightward direction, in the scale sensor 72, first, the A-phase output sensor 72*a* which outputs an A-phase waveform signal (pulse) moves from the first section S1 to the second section S2 and then when the A-phase output sensor 72*a* detects switching of the section, the level of the output is changed. That is, the A-phase output sensor 72*a* outputs the high (H)-level waveform signal (pulse) at the light transmission timing Ta which is the output change point T concerned.

At this time point, the output from the B-phase output sensor 72*b* which outputs a B-phase waveform signal (pulse) is still in the low (L)-level state and thereafter the B-phase output sensor 72*b* outputs the high (H)-level waveform signal (pulse) with a delay of ¼ cycle (see FIG. 5).

On the other hand, in a case where the moving body (the print head 41 and so forth) is moving in the leftward direction, in the scale sensor 72, the level of the output from the B-phase output sensor 72*b* is changed first. Therefore, for example, the B-phase output sensor 72*b* moves from the first section S1 to the second section S2, when the B-phase output sensor 72*b* detects switching of the section, the level of the output is changed and the B-phase output sensor 72*b* outputs the high (H)-level waveform signal (pulse) at the light transmission timing Ta which is the output change point T concerned. Then, the A-phase output sensor 72*a* moves from the first section S1 to the second section S2 with the delay of ¼ cycle and outputs the high (H)-level waveform signal (pulse).

In this case, at the time that the A-phase output sensor 72*a* moves from the first section S1 to the second section S2 and outputs the high (H)-level waveform signal (pulse), the B-phase output sensor 72*b* is already in a state of outputting the high (H)-level waveform signal (pulse).

Accordingly, it becomes possible for the position detection control section 816 to detect the moving direction of the moving body (the print head 41 and so forth) by seeing which signal (pulse) is output from the B-phase output sensor 72*b* between the low (L)-level and high (H)-level waveform signals (pulses) when the A-phase output sensor 72*a* outputs the high (H)-level waveform signal (pulse).

Incidentally, here, a case of seeing the level of the output signal (pulse) from the B-phase output sensor 72*b* when the A-phase output sensor 72*a* moves from the first section S1 to the second section S2 and detects switching of the section and thereby the level of the output signal (pulse) from the A-phase output sensor 72*a* is changed to the high (H) level is exemplified. However, it is also possible to decide the moving direction of the moving body (the print head 41 and so forth) from the same relation also by seeing the level of the output signal (pulse) from the B-phase output sensor 72*b* when the A-phase output sensor 72*a* moves from the second section S2 to the first section S1, detects switching of the section and outputs the low (L)-level waveform signal (pulse) at the light shielding timing Tb which is the output change point T concerned.

Further, in a case where the moving body (the print head 41 and so forth) is of the type of performing the operation on the basis of the instructions and control while reciprocally moving in the predetermined range as in the present embodiment, when an operation timing (an ink ejection timing in the present embodiment) of the operation which includes movement of the moving body (the print head 41 and so forth) on the forward path deviates from the operation timing on the backward path, also ink landing positions deviate from each other on the forward path and the backward path and printing does no result in a beautiful finish.

Figure 9:
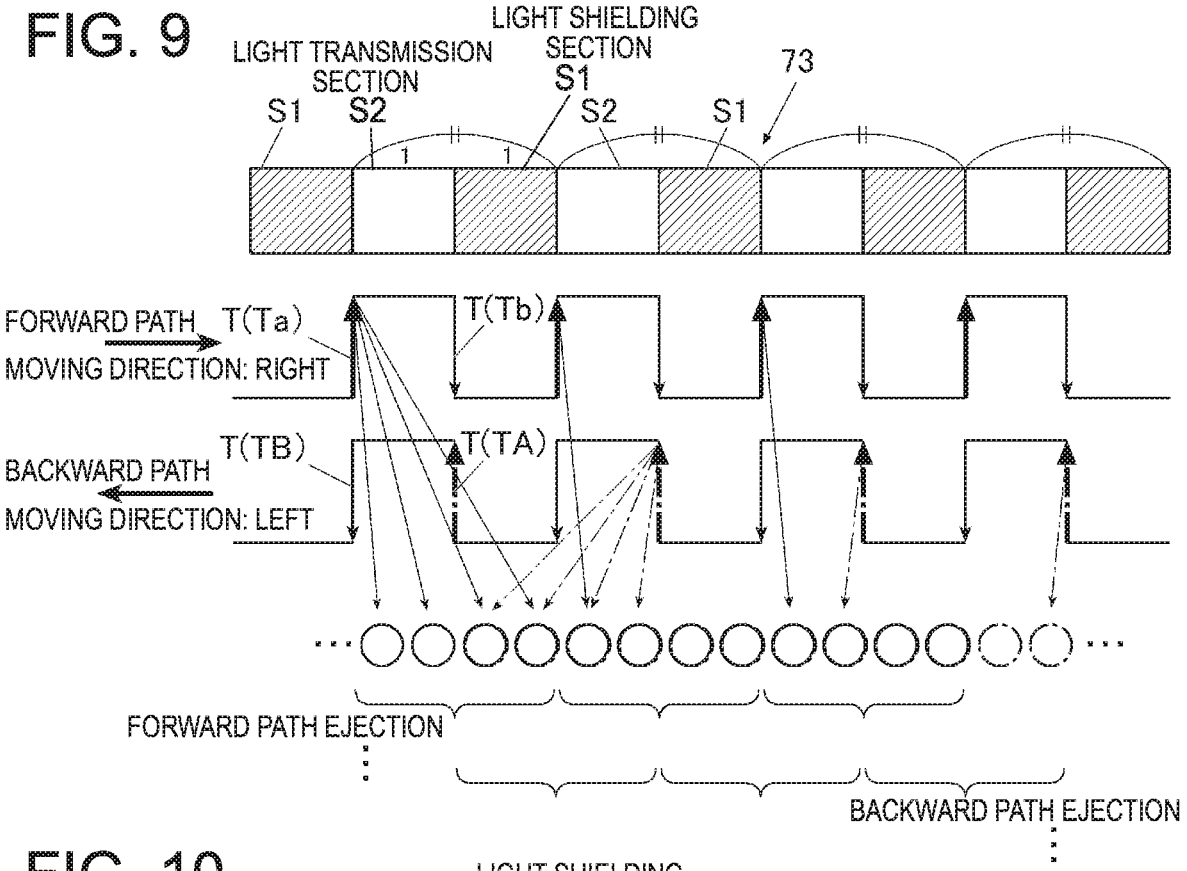
FIG. 9 is an explanatory diagram illustrating one example of an operation instruction timing and operation instruction timing-dependent ink ejection in a case where a light shielding section and a light transmission section of the linear scale are formed in the ratio of 1 to 1.
Figure 10:
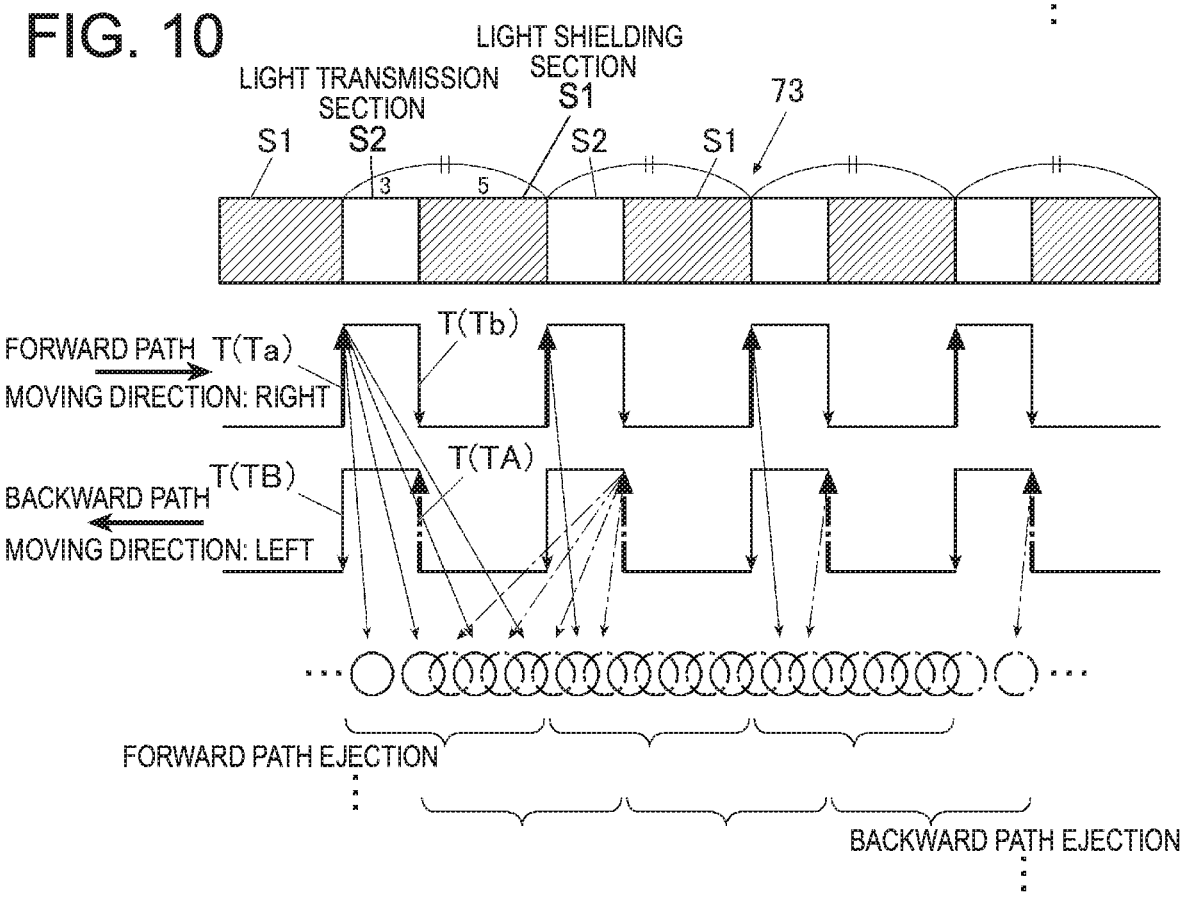
FIG. 10 is an explanatory diagram illustrating one example of an existing operation instruction timing and existing operation instruction timing-dependent ink ejection in a case where the light shielding section and the light transmission section of the linear scale are formed in the ratio of 3 to 5.
Figure 11:
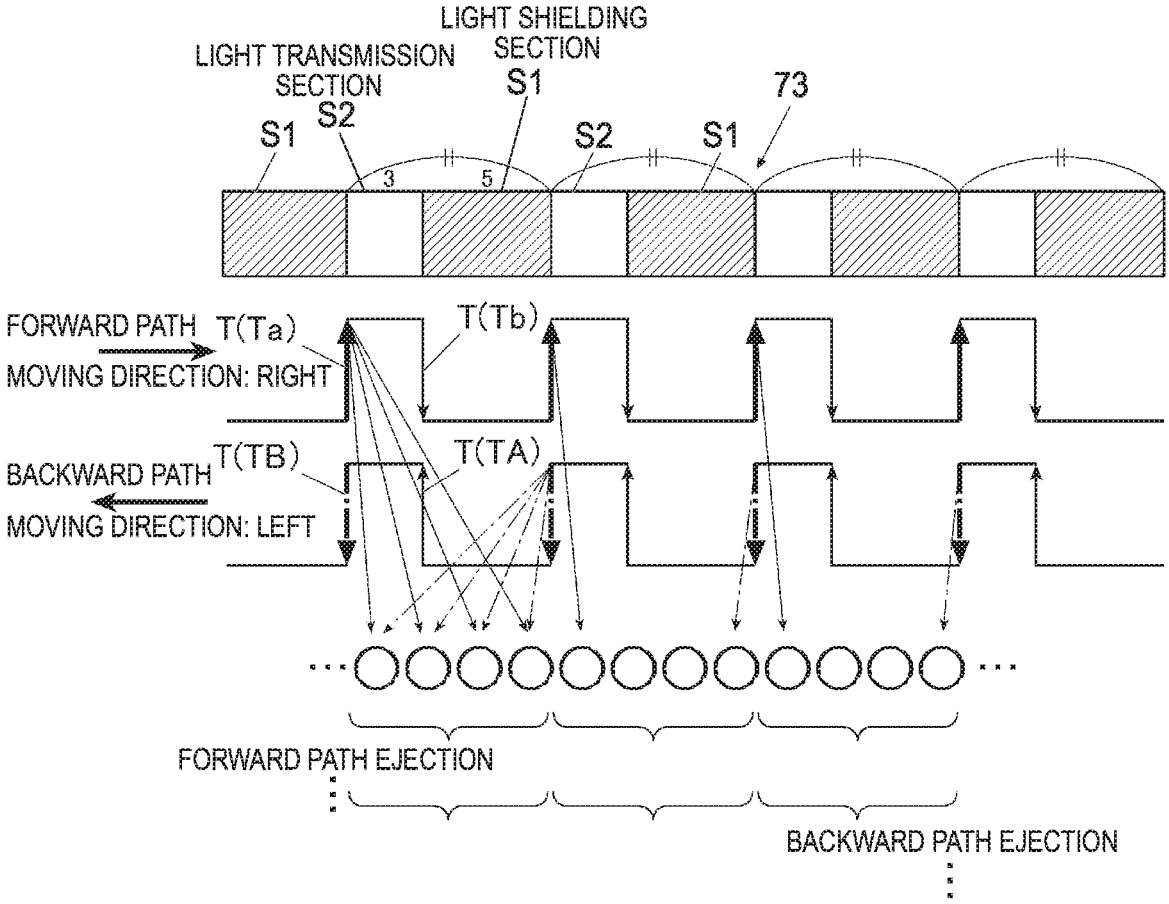
FIG. 11 is an explanatory diagram illustrating one example of an operation instruction timing and operation instruction timing-dependent ink ejection in a case where the light shielding section and the light transmission section of the linear scale are formed in the ratio of 3 to 5 in the present embodiment.

In FIG. 9 to FIG. 11, a case where the moving body (the print head 41 and so forth) performs the operation (the ink ejection operation) every four times on the forward path and the backward path when an operation instruction signal is output at an operation instruction timing is exemplified and the ejected ink landing position is schematically marked with "o". In addition, the output change point T (the light transmission timing Ta(A) or the light shielding timing Tb(B)) which is set as the operation instruction timing is marked with a thick arrow.

As illustrated in FIG. 9, in a case where the ratio between the first section S1 and the second section S2 which configure one cycle on the linear scale 73 is one-to-one, for example, even in a case where only the output change point T (the light transmission timing Ta(A)) that switching from the first section S1 to the second section S2 is conducted is set as the operation instruction timing on both the forward path and the backward path of the moving body (the print head 41 and so forth), the ink which is ejected on the forward path and the ink which is ejected on the backward path are mutually superposed with no deviation. Therefore, it becomes possible to print an image which is sharply and beautifully finished with no blurring and deviation such as an image which is illustrated, for example, in FIG. 13. In addition, also in a case where only the output change point T (the light shielding timing Tb(B)) that switching from the second section S2 to the first section S1 is conducted is set as the operation instruction timing, the ink which is ejected on the forward path and the ink which is ejected on the backward path are mutually superposed with no deviation similarly.

However, since, on the linear scale 73, the first section S1 which is the light shielding section and the second section S2 which is the light transmission section are formed in a one-cycle division by a method such as etching and so forth, widths of the respective one-cycle divisions are almost equal to one another as illustrated in FIG. 9 to FIG. 11. However, there is the possibility that widths of the first section S1 and the second section S2 which configure one cycle may be varied due to occurrence of a deviation such as expansion of a range to be masked and so forth. As a result, the ratio between the first section S1 and the second section S2 does not become necessarily one-to-one.

For example, FIG. 10 and FIG. 11 illustrate examples that the ratio between the first section S1 and the second section S2 is five-to-three. Incidentally, all the first sections S1 and the second sections S2 are not necessarily set on the linear scale 73 in the same ratio and there may be a case where the first sections S1 and the second sections S2 which configure respective one-cycle divisions are set in various ratios.

Figure 12:
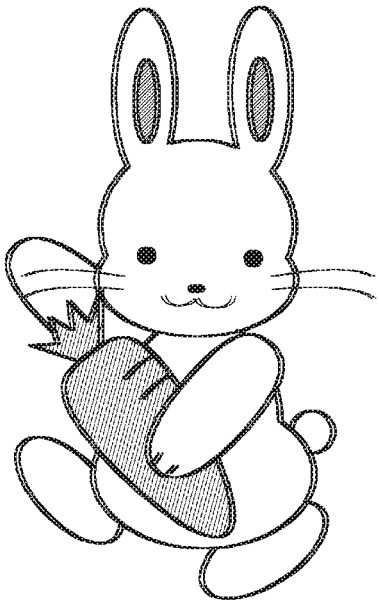
FIG. 12 is a plan view illustrating one example of a printed result which is obtained in a case where the printing is performed in accordance with the method illustrated in FIG. 10.

As illustrated in FIG. 10 and FIG. 11, in a case where the ratio between the first section S1 and the second section S2 is not one-to-one, when the output change point T (the light transmission timing Ta(A)) that switching from the first section S1 to the second section S2 is conducted is set as the operation instruction timing on both the forward path and the backward path of the moving body (the print head 41 and so forth) similarly to the case in FIG. 9 that the ratio is one-to-one, the operation timings deviate from each other on the forward path and the backward path and ink landing positions of the ink which is ejected on the forward path and the ink which is ejected on the backward path are not mutually superposed as illustrated in FIG. 10 and consequently an image which deviates in position, is blurry and lacks sharpness as a whole is printed as illustrated, for example, in FIG. 12. Likewise, also in a case where only the output change point T (the light shielding timing Tb(B)) that switching from the second section S2 to the first section S1 is conducted is set as the operation instruction timing, the ink landing positions of the ink which is ejected on the forward path and the ink which is ejected on the backward path are not mutually superposed.

In this respect, in the present embodiment, the position detection control section 816 sets either the light transmission timing Ta or the light shielding timing Tb as the operation instruction timing of the moving body (the print head 41 and so forth) on the forward path, and sets the position of the moving body (the print head 41 and so forth) which is obtained at the light transmission timing Ta or the light shielding timing Tb which is set as the operation instruction timing as the operation instruction position and sets the operation instruction position also as the operation instruction position of the moving body (the print head 41 and so forth) on the backward path.

That is, in a case where the light transmission timing Ta is set as the operation instruction timing of the moving body (the print head 41 and so forth) on the forward path as illustrated in FIG. 11, on the backward path, the position detection control section 816 adopts the light shielding timing TB which is the backward-path output change point T (that is, the timing that the edge which is the same as the edge which becomes the boundary between the first section S1 and the second section S2 on the liner scale 73 that the scale sensor 72 detects on the forward path is detected) which corresponds to the output change point T (the light transmission timing Ta) on the forward path as the operation instruction timing on the backward path.

Figure 13:
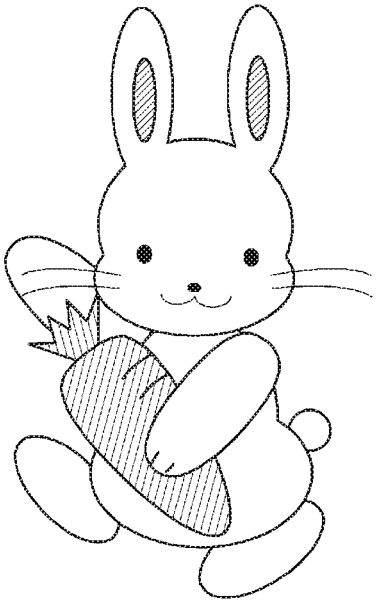
FIG. 13 is a plan view illustrating one example of a printed result which is obtained in a case where the printing is performed in accordance with the method illustrated in FIG. 11.

The deviation between the operation instruction timings on the forward path and the backward path is eliminated by adopting the timing that the scale sensor 72 detects the same edge on the linear scale 73 on the forward path and the backward path as the operation instruction timing in this way, regardless of which timing is adopted between the light transmission timing Ta(A) and the light shielding timing Tb(B) (that is, whether an arrow in FIG. 11 and so forth is tuned upward or downward). Thereby, since no deviation occurs in position of the moving body (the print head 41 and so forth) at the operation instruction timing similarly to the case in FIG. 9 that the ratio between the first section S1 and the second section S2 of the linear scale 73 is constant, it becomes possible to print the image which is sharply and beautifully finished with no blurring and positional deviation such as an image which is illustrated in FIG. 13.

Incidentally, information on the original point Op of the moving body (the print head 41 and so forth) which is set by the position detection control section 816, the operation instruction position which becomes a trigger of ink ejection from the print head 41 and so forth is stored in the print position information storage area 823 in the storage unit 82.

Next, a position detection method which is performed by the position detection device 70 and working of the nail printing apparatus 1 which includes the position detection device 70 according to the present embodiment will be described.

In the present embodiment, the original point Op is set on the nail printing apparatus 1 by the calibration.

Figure 14:
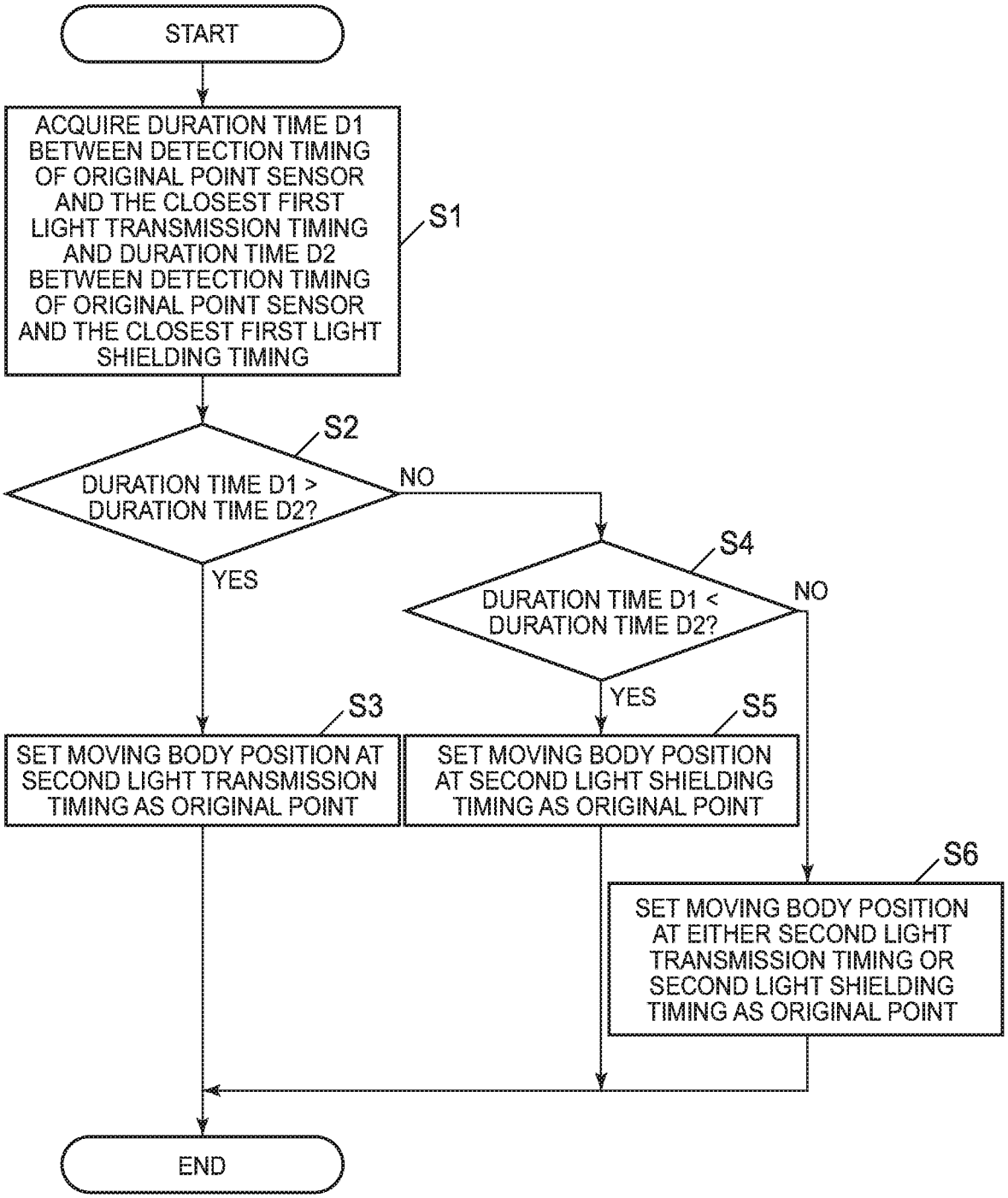
FIG. 14 is a flowchart illustrating one example of setting an operation start timing in the present embodiment.

Specifically, in a case where the detection timing is set while the moving body (the print head 41 and so forth) is moving in the rightward direction and the A-phase output sensor 72*a* is outputting the high (H)-level waveform signal (pulse), the position detection control section 816 acquires the duration time D1 between the detection timing of the original point sensor 71 and the first light transmission timing Ta1 which is the closest to the detection timing and the duration time D2 between the detection timing of the original point sensor 71 and the first light shielding timing Tb1 which is the closest to the detection timing (step S1) as indicated in the flowchart in FIG. 14.

Then, the position detection control section 816 decides whether the relation of the duration time D1>the duration time D2 is satisfied (step S2). In a case where the relation is satisfied (step S2: YES), the position detection control section 816 sets the point that switching from the first section S1 to the second section S2 is conducted after the detection timing as the second light transmission timing Ta2 and sets the position of the moving body (the print head 41 and so forth) which is obtained at the second light transmission timing Ta2 as the original point Op (step S3, see FIG. 7B).

On the other hand, in a case where the relation of the duration time D1>the duration time D2 is not satisfied (step S2: NO), the position detection control section 816 decides whether the relation of the duration time D1<the duration time D2 is satisfied (step S4). In a case where the relation is satisfied (step S4: YES), the position detection control section 816 sets the point that switching from the second section S2 to the first section S1 is conducted after the detection timing as the second light shielding timing (the first light shielding timing) Tb1 and sets the position of the moving body (the print head 41 and so forth) which is obtained at the second light shielding timing (the first light shielding timing) Tb1 as the original point Op (step S5, see FIG. 7A).

In addition, in a case where also the relation of the duration time D1<the duration time D2 is not satisfied (step S4: NO), that is, the relation of the duration time D1=the duration time D2 is satisfied, the position detection control section 816 sets the position of the moving body (the print head 41 and so forth) which is obtained at either the output change point T which is the second light transmission timing Ta2 or the output change point T which is the second light shielding timing (the first light shielding timing) Tb1 as the original point Op (step S6).

Incidentally, the order of execution of original point Op setting processing is not limited to the order of execution of the processing which is illustrated in FIG. 14.

Incidentally, in a case where the detection timing is set while the moving body (the print head 41 and so forth) is moving in the rightward direction and the A-phase output sensor 72*a* is outputting the low (L)-level waveform signal (pulse), the position detection control section 816 acquires the duration time D3 between the detection timing of the original point sensor 71 and the first light shielding timing Tb1 which is the closest to the detection timing and the duration time D4 between the detection timing of the original point sensor 71 and the second light transmission timing Ta2 which is the closest to the detection timing, performs the processing which is the same as the above-described processing and thereby sets the original point Op.

In a case of performing the printing by using the nail printing apparatus 1, first, the user turns on a power switch and starts up the control device 80.

Thereby, initialization processing is executed on respective components of the nail printing apparatus 1.

By execution of the initialization processing, the position detection control section 816 sets the temporary original point which becomes a reference of the position when the print head 41 ejects ink in accordance with the result of detection by the position detection device 70 and outputs the operation instruction signal which instructs a timing that the print head 41 ejects the ink at the operation instruction timing.

As a premise for outputting the operation instruction signal, the position detection control section 816 sets the operation instruction timing depending on which edge on the linear scale 73 the scale sensor 72 detects at which timing. Then, in a case where the print head 41 performs the ink ejecting operation while reciprocally moving, the position detection control section 816 sets the operation instruction position on the forward path as the operation instruction position on the backward path. Thereby, the timing that the scale sensor 72 detects the edge at the same position on the linear scale 73 on the forward path and the backward path is set as the operation instruction timing, as illustrated in FIG. 11.

In addition, the display control section 815 makes the display unit 23 display the design selection screen. Then, the user operates the operation unit 22 and so forth and selects a desired nail design from a plurality of nail designs which is displayed on the design selection screen. Thereby, the selection instruction signal is output from the operation unit 22 and one nail design is selected.

In a case where the user inserts her/his finger into the nail printing apparatus 1 and the nail which becomes the printing object is set on a predetermined position, the photograph control section 811 controls the photographing unit 50 so as to take the photograph of the nail and thereby captures the nail image.

In a case where the nail image is captured, the nail information detection section 812 detects the nail information on the shape of the nail (e.g., the contour of the nail, the nail area) and so forth from the nail image.

In a case where the nail information on the nail shape (e.g., the nail contour, the nail region) and so forth is acquired, the data for printing is generated by the print data generation section 813 by matching the image data on the nail design and the nail and appropriately performing correction. The generated data for printing is sent to the print control section 814.

In a case where the data for printing is sent to the print control section 814, the print control section 814 outputs the data for printing to the print unit 40 and print processing which is based on the data for printing is performed by the print unit 40.

In this case, the print control section 814 sets coordinates of a print start position with reference to an operation start timing St (the original point Op) and so forth of the print head 41 which is set by the position detection control section 816 and is stored in the print position information storage area 823.

In addition, in a case where the operation instruction signal is output from the position detection control section 816 at every operation instruction timing, the print control section 814 receives the operation instruction signal and controls the print head 41 to eject the predetermined ink and to perform the printing on the nail.

The print control section 814 grasps also the position, the moving direction and so forth of the print head 41 on the basis of detection information which is sent from the position detection control section 816 and the print control section 814 controls a printing operation performed by the print unit 40 with reference to also the information on the position, the moving direction and so forth of the print head 41.

The nail printing apparatus 1 according to the present embodiment is capable of applying a nail print which is sharply and beautifully finished with no blurring, deviation in print position and so forth onto the nail by performing the printing by controlling the print unit 40 while referring to the result of detection by the position detection device 70 in this way.

As described above, according to the present embodiment, the position detection device 70 is adapted to detect the position of the moving body (the print head 41 and so forth), and has the original point sensor 71 which detects arrival of the moving body (the print head 41 and so forth) when the moving body (the print head 41 and so forth) arrives at the predetermined position and outputs the detection signal, the linear scale 73 and the scale sensor 72, and the control unit 81 includes the position detection control section 816 which controls the linear encoder 75 which detects the amount of movement of the moving body (the print head 41 and so forth), the original point sensor 71 and the scale sensor 72. Thereby, it becomes possible to grasp the position and so forth of the moving body (the print head 41 and so forth) by a comparatively simple configuration.

Then, in the present embodiment, the linear scale 73 is configured by alternately arranging the first section S1 that the output from the scale sensor 72 becomes low and the second section S2 that the output from the scale sensor 72 becomes high. In this case, when the output change point T that the scale sensor 72 detects switching from the first section S1 to the second section S2 is set as the light transmission timing Ta(A), the output change point T that the scale sensor 72 detects switching from the second section S2 to the first section S1 is set as the light shielding timing Tb(B), and the output change point that the original point sensor 71 detects is set as the detection timing, in a case where the detection timing is set while the moving body (the print head 41 and so forth) is moving in the rightward direction and the A-phase output sensor 72*a* is outputting the high (H)-level waveform signal (pulse), the position detection control section 816 compares the duration time D1 between the detection timing and the first light transmission timing Ta1 which is the closest to the detection timing with the duration time D2 between the detection timing and the first light shielding timing Tb1 which is the closest to the detection timing, in a case where the relation of the duration time D1>the duration time D2 is satisfied, sets the point that switching from the first section S1 to the second section S2 is conducted after the detection timing as the second light transmission timing Ta2 and sets the position of the moving body (the print head 41 and so forth) which is obtained at the second light transmission timing Ta2 as the original point Op of the moving body (the print head 41 and so forth). In addition, in a case where the relation of the duration time D1<the duration time D2 is satisfied, the position detection control section 816 sets the point that switching from the second section S2 to the first section S1 is conducted after the detection timing as the second light shielding timing (the first light shielding timing) Tb1 and sets the position of the moving body (the print head 41 and so forth) which is obtained at the second light shielding timing (the first light shielding timing) Tb1 as the original point Op of the moving body (the print head 41 and so forth).

On the other hand, in a case where the detection timing is set while the moving body (the print head 41 and so forth) is moving in the rightward direction and the A-phase output sensor 72*a* is outputting the low (L)-level waveform signal (pulse), the position detection control section 816 compares the duration time D3 between the detection timing and the first light shielding timing Tb1 which is the closest to the detection timing with the duration time D4 between the detection timing and the second light transmission timing Ta2 which is the closest to the detection timing, when the relation of the duration time D3>the duration time D4 is satisfied, sets the point that switching from the second section S2 to the first section S1 is conducted after the detection timing as the second light shielding timing Tb2, and sets the position of the moving body (the print head 41 and so forth) which is obtained at the second light shielding timing Tb2 as the original point Op of the moving body (the print head 41 and so forth). In addition, when the relation of the duration time D3<the duration time D4 is satisfied, the position detection control section 816 sets the point that switching from the first section S1 to the second section S2 is conducted after the detection timing as the second light transmission timing (the first light transmission timing) Ta2 and sets the position of the moving body (the print head 41 and so forth) which is obtained at the second light transmission timing (the first light transmission timing) Ta2 as the original point Op of the moving body (the print head 41 and so forth).

Figure 8B:
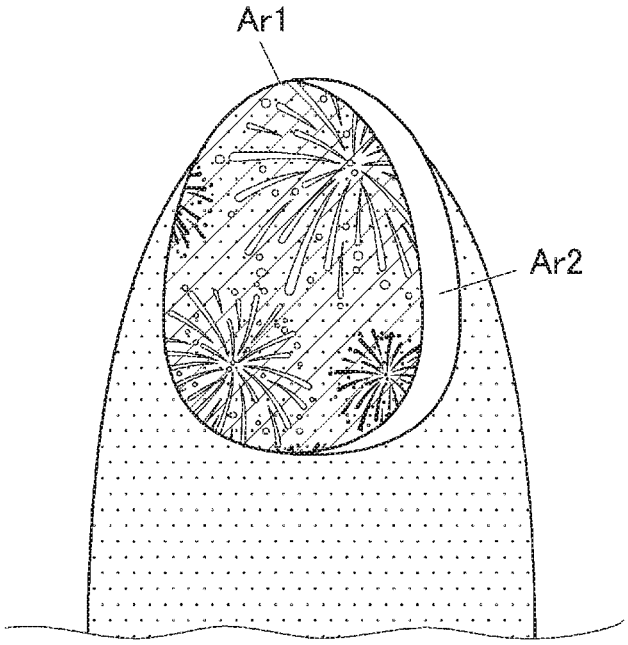
FIG. 8B is a plan view illustrating one example of a printed result which is obtained in a case where the printing is performed in a state where deviation occurs on the original point.

Thereby, it becomes possible to prevent the deviation between the original point Op and the temporary original point of the moving body (the print head 41 and so forth) from increasing to such an extent which corresponds to one cycle and so forth on the linear scale 73, that is, to such an extent that the deviation is observed prominently when the result of printing is visually confirmed and thereby to prevent the printed image from being finished with the unpainted area Ar2 being left in a prominently observed state as illustrated in FIG. 8B.

In addition, in the present embodiment, in a case where the relation of the duration time D1=the duration time D2 (the duration time D3=the duration time D4) is satisfied, the position detection control section 816 sets the position of the moving body (the print head 41 and so forth) which is obtained at either the second light transmission timing Ta2 or the second light shielding timing (the first light shielding timing) Tb1 as the original point Op of the moving body (the print head 41 and so forth).

In a case where the relation of the duration time D1=the duration time D2 (the duration time D3=the duration time D4) is satisfied, even when the position of the moving body (the print head 41 and so forth) which is obtained at either the second light transmission timing Ta2 or the second light shielding timing (the first light shielding timing) Tb1 is set as the original point Op, the positional deviation is hard to occur almost equally in both cases. Accordingly, in such a case, it becomes possible to facilitate processing by adopting either the timing Ta2 or the timing Tb1.

In addition, as indicated in the present embodiment, in a case where the moving body (the print head 41 and so forth) is of the type of performing the operation while reciprocally moving in the predetermined range on the basis of the instructions and control, the position detection control section 816 sets the position which is set as the original point Op of the moving body (the print head 41 and so forth) on the forward path also as the original point Op of the moving body (the print head 41 and so forth) on the backward path.

Thereby, it becomes possible for the moving body (the print head 41 and so forth) to reciprocally move by turning back with the appropriate original point Op being set as the reference.

In addition, as indicated in the present embodiment, in a case where the moving body (the print head 41 and so forth) is of the type of performing the operation while reciprocally moving in the predetermined range on the basis of the instructions and control, the position detection control section 816 sets either the light transmission timing or the light shielding timing as the operation instruction timing of the moving body (the print head 41 and so forth) on the forward path, and with the position of the moving body (the print head 41 and so forth) which is obtained at the light transmission timing or the light shielding timing which is set as the operation instruction timing on the forward path being set as the operation instruction position, adopts the backward-path output change point of the moving body (the print head 41 and so forth) at the operation instruction position also as the operation instruction timing.

Even in a case where unevenness and variation such as those illustrated in FIG. 10 and FIG. 11 are found in the ratio between the light shielding section (the first section S1) and the light transmission section (the second section S2) of the linear scale 73, it becomes possible to make the print head 41 eject the ink to the same position on the forward path and the backward path (see FIG. 11) and thereby it becomes possible to print the image which is free from blurring and positional deviation and is excellent in sharpness and beauty such as the image which is illustrated in FIG. 13 by performing the printing in this way.

In addition, in a case where the position detection device 70 which is configured as mentioned above is applied to the nail printing apparatus 1 which is the printing apparatus, the operations of the moving body (the print head 41 and so forth) including the moving operation are instructed and controlled in accordance with the result of detection by the position detection device 70.

Accordingly, in a case of performing the printing on the printing object which is small in the printing object area Ar1 such as the nail, it becomes possible to perform high-definition printing which is free from blurring and positional deviation and is excellent in sharpness and beauty and it becomes possible to realize the nail print which is finished attractively and beautifully.

Incidentally, although the embodiment of the present invention has been described so far, it goes without saying that the present invention is not limited to the above-described embodiment and may be altered and modified in a variety of ways within the range not deviating from the gist of the present invention.

For example, it is sufficient for the linear encoder 75 to have the ability to detect the amount of movement of the moving body (the print head 41 and so forth) and it is not essential for the linear encoder 75 to know the moving direction.

For example, in a case where there is no need to know the moving direction in such as a case where the moving body (the print head 41 and so forth) is of the type of moving in one direction and so forth, the scale sensor 72 may be configured by only one light reception unit so as to output only a one-phase waveform signal (pulse). Also, in this case, it is possible to grasp the amount of movement (the moving distance) of the moving body (the print head 41 and so forth) by counting the number of signals (pulses) which are output from the scale sensor 72.

In addition, in the present embodiment, the case where when the detection timing is set while the moving body (the print head 41 and so forth) is moving in the rightward direction and the A-phase output sensor 72*a* is outputting the high (H)-level waveform signal (pulse), the position detection control section 816 sets the original point Op and the operation instruction position of the moving body (the print head 41 and so forth), focusing on any timing (the output change point T) that, in the scale sensor 72, the A-phase output sensor 72*a* which outputs the A-phase waveform signal (pulse) detects the edge of the linear scale 73 is exemplified in FIG. 7A, FIG. 7B, FIG. 11 and so forth.

However, the timing (the output change point T) to be focused when setting the original point Op and the operation instruction position of the moving body (the print head 41 and so forth) is not limited to the above-described timing.

The original point Op and the operation instruction position may be set by focusing on any timing (the output change point T) that the A-phase output sensor 72*a* detects the edge of the linear scale 73, for example, in a case where the moving body (the print head 41 and so forth) moves in the leftward direction.

In addition, the original point Op and the operation instruction position may be set by focusing on any timing (the output change point T) that the B-phase output sensor 72*b* detects the edge of the linear scale 73 in a case where the moving body (the print head 41 and so forth) moves in the rightward or leftward direction.

In addition, in the present embodiment, the position of the moving body (the print head 41 and so forth) which is obtained at either the second light transmission timing or the second light shielding timing is set as the original point Op by comparing the duration time D1 with the duration time D2. However, which duration time is longer between the duration time D1 and the duration time D2 may be decided by comparing a duration time which is taken for movement of ¼ cycle with the duration time D1 and with the duration time D2 respectively.

In addition, in the present embodiment, the case where the position of the moving body (the print head 41 and so forth) which is obtained at the second light transmission timing or the second light shielding timing is set as the original point Op is exemplified. However, the present invention is not limited to the case. For example, the position of the moving body (the print head 41 and so forth) which is obtained at the second light transmission timing or the second light shielding timing may be set as a reference position which serves as a reference of the original point and a position which is obtained when the moving body (the print head 41 and so forth) moves by the amount corresponding to several cycles or several seconds from the reference position may be set as the original point.

In addition, in the present embodiment, the case where the nail design storage area 821, the nail information storage area 822, the print position information storage area 823 and so forth are included in the storage unit 82 of the control device 80 is exemplified. However, the present invention is not limited to the case where the storage areas 821, 822, 823 and so forth are included in the storage unit 82 (the ROM, the RAM and so forth) of the control device 80, the storage areas 821, 822, 823 and so forth may be included in a storage unit which is additionally installed.

In addition, information which is stored in an external terminal may be used by operating the nail printing apparatus 1 in cooperation with the external terminal.

Although the embodiments and some modified examples of the present invention have been described above, the scope of the present invention is not limited to the above-described embodiment and modified examples and includes the scope of the invention which is described in the appended claims and a scope of equivalency thereof.

What is claimed is:

1. A position detection device which detects a position of a moving body, comprising:

a position sensor which detects the moving body and outputs a detection signal;

an encoder which has a scale and a scale sensor and detects an amount of movement of the moving body in one direction; and a processor which controls the position sensor and the scale sensor, wherein a first section that an output from the scale sensor becomes low and a second section that the output from the scale sensor becomes high are alternately arranged on the scale, and in a case where an output change point that the scale sensor detects switching from the first section to the second section is set as a light transmission timing, an output change point that the scale sensor detects switching from the second section to the first section is set as a light shielding timing and an output change point that the position sensor detects is set as a detection timing, with the light transmission timing which is the closest to the detection timing being set as a first light transmission timing and the light shielding timing which is the closest to the detection timing being set as a first light shielding timing, the processor sets a position of the moving body which is obtained at a second light transmission timing which is the light transmission timing which comes after the detection timing as an original point position in the one direction or a reference position which serves as a reference of the original point position, (1) in a case where a duration time D1 between the detection timing and the first light transmission timing is longer than a duration time D2 between the detection timing and the first light shielding timing, and sets a position of the moving body which is obtained at a second light shielding timing which is the light shielding timing which comes after the detection timing as the original point position in the one direction or the reference position, (2) in a case where the duration time D1 is shorter than the duration time D2.

2. The position detection device according to claim 1, wherein in a case where the duration time D1 and the duration time D2 are equal to each other, the processor sets the position of the moving body which is obtained at either the second light transmission timing or the second light shielding timing as the original point position in the one direction or the reference position.

3. The position detection device according to claim 1, wherein the processor compares the duration time D1 with the duration time D2, in a case where the duration time D1 is longer than the duration time D2, sets the position of the moving body which is obtained at the second light transmission timing as the original point position in the one direction or the reference position, and in a case where the duration time D1 is shorter than the duration time D2, sets the position of the moving body which is obtained at the second light shielding timing as the original point position in the one direction or the reference position.

4. The position detection device according to claim 1, wherein the processor sets the light transmission timing and the light shielding timing which are the closest to the detection timing before and after the detection timing as the first light transmission timing and the first light shielding timing respectively.

5. The position detection device according to claim 1, wherein the processor, in a case where the duration time D1 is longer than the duration time D2, sets the light transmission timing which comes after the detection timing and is the closest to the detection timing as the second light transmission timing, and in a case where the duration time D1 is shorter than the duration time D2, sets the light shielding timing which comes after the detection timing and is the closest to the detection timing as the second light shielding timing.

6. The position detection device according to claim 1, wherein the moving body operates on the basis of instructions and control while reciprocally moving in a predetermined range and the processor, in a case of setting either the light transmission timing or the light shielding timing of the moving body on a forward path as an operation instruction timing for making the moving body perform an operation which includes the reciprocal movement that a user wishes, sets a position of the moving body which is obtained at the operation instruction timing as an operation instruction position on the forward path and a backward path.

7. A printing apparatus comprising:

a position detection device which detects a position of a moving body and includes a position sensor which detects the moving body and outputs a detection signal, an encoder which has a scale and a scale sensor and detects an amount of movement of the moving body in one direction and a processor which controls the position sensor and the scale sensor, wherein a first section that an output from the scale sensor becomes low and a second section that the output from the scale sensor becomes high are alternately arranged on the scale, and in a case where an output change point that the scale sensor detects switching from the first section to the second section is set as a light transmission timing, an output change point that the scale sensor detects switching from the second section to the first section is set as a light shielding timing and an output change point that the position sensor detects is set as a detection timing, with the light transmission timing which is the closest to the detection timing being set as a first light transmission timing and the light shielding timing which is the closest to the detection timing being set as a first light shielding timing, the processor sets a position of the moving body which is obtained at a second light transmission timing which is the light transmission timing which comes after the detection timing as an original point position in the one direction or a reference position which serves as a reference of the original point position, (1) in a case where a duration time D1 between the detection timing and the first light transmission timing is longer than a duration time D2 between the detection timing and the first light shielding timing, and sets a position of the moving body which is obtained at a second light shielding timing which is the light shielding timing which comes after the detection timing as the original point position in the one direction or the reference position, (2) in a case where the duration time D1 is shorter than the duration time D2;

the moving body includes a print head which performs an ink ejecting operation while moving reciprocally, and the processor instructs and controls the operation of the moving body in accordance with a result of detection by the position detection device.

8. A position detection method for a position detection device which detects a position of a moving body and includes a position sensor which detects the moving body and outputs a detection signal, an encoder which has a scale and a scale sensor and detects an amount of movement of the moving body in one direction and a processor which controls the position sensor and the scale sensor, wherein a first section that an output from the scale sensor becomes low and a second section that the output from the scale sensor becomes high are alternately arranged on the scale, and in a case where an output change point that the scale sensor detects switching from the first section to the second section is set as a light transmission timing, an output change point that the scale sensor detects switching from the second section to the first section is set as a light shielding timing and an output change point that the position sensor detects is set as a detection timing, with the light transmission timing which is the closest to the detection timing being set as a first light transmission timing and the light shielding timing which is the closest to the detection timing being set as a first light shielding timing, the method comprising:

setting a position of the moving body which is obtained at a second light transmission timing which is the light transmission timing which comes after the detection timing as an original point position in the one direction or a reference position which serves as a reference of the original point position by the processor, (1) in a case where a duration time D1 between the detection timing and the first light transmission timing is longer than a duration time D2 between the detection timing and the first light shielding timing; and setting a position of the moving body which is obtained at a second light shielding timing which is the light shielding timing which comes after the detection timing as the original point position in the one direction or the reference position by the processor, (2) in a case where the duration time D1 is shorter than the duration time D2.

* * * * *